US011274013B2

(12) United States Patent
Shimizu et al.

(10) Patent No.: US 11,274,013 B2
(45) Date of Patent: Mar. 15, 2022

(54) SHEET FOLDING APPARATUS

(71) Applicants: Tomohisa Shimizu, Yamanashi-ken (JP); Dai Tamura, Yamanashi-ken (JP); Daichi Tojo, Yamanashi-ken (JP)

(72) Inventors: Tomohisa Shimizu, Yamanashi-ken (JP); Dai Tamura, Yamanashi-ken (JP); Daichi Tojo, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 80 days.

(21) Appl. No.: 16/707,654

(22) Filed: Dec. 9, 2019

(65) Prior Publication Data

US 2020/0180896 A1 Jun. 11, 2020

(30) Foreign Application Priority Data

Dec. 10, 2018 (JP) ..... JP2018-230527
Dec. 27, 2018 (JP) ..... JP2018-245126
May 21, 2019 (JP) ..... JP2019-094929

(51) Int. Cl.
*B41L 39/16* (2006.01)
*B65H 45/101* (2006.01)

(52) U.S. Cl.
CPC ..... *B65H 45/101* (2013.01)

(58) Field of Classification Search
None
See application file for complete search history.

(56) References Cited

U.S. PATENT DOCUMENTS 8,256,757 B2 * 9/2012 Imazu ..... B65H 45/148 270/32
8,590,880 B2 * 11/2013 Imazu ..... B65H 45/148 270/20.1
9,168,762 B2 * 10/2015 Nakamura ..... G03G 15/6529

FOREIGN PATENT DOCUMENTS

| | | | |
|---|---|---|---|
| JP | H05-319686 | A | 12/1993 |
| JP | 2001-171907 | A | 6/2001 |
| JP | 2002-068583 | A | 3/2002 |
| JP | 2005-067741 | A | 3/2005 |
| JP | 2008-207924 | A | 9/2008 |
| JP | 2008-247531 | A | 10/2008 |
| JP | 2012-111567 | A | 6/2012 |
| JP | 2016-182998 | A | 10/2016 |
| JP | 2016-216185 | A | 12/2016 |
| JP | 2017-128441 | A | 7/2017 |

* cited by examiner

*Primary Examiner* — Leslie A Nicholson, III
(74) *Attorney, Agent, or Firm* — Manabu Kanesaka

(57) ABSTRACT

Disclosed herein is a sheet-folding apparatus which includes transporting rollers, folding rollers, a pushing member provided between the transporting rollers and the folding-rollers, and a guide unit for guiding the sheet to the folding-roller pair by using the pushing member.

16 Claims, 19 Drawing Sheets

SHEET FOLDING APPARATUS

BACKGROUND OF THE INVENTION

1. Field of the Invention

The present invention relates to a sheet folding apparatus configured to perform a sheet folding process.

2. Description of Related Arts

Hitherto, sheet folding apparatuses have been known, which are used in image forming apparatuses such as copiers and printers and which fold a sheet along center line to form two parts, or along two lines on the same side to form three parts, or along two lines at opposite sides, respectively, to form a Z-held sheet.

JP 2002-068583 A and JP 2008-207924 A, for example, disclose sheet folding apparatuses which comprise a sheet-folding roller pair configured to fold a sheet, a sheet-feeding roller pair configured to feed the sheet to the sheet-folding roller pair, a small roller provided at the front of the sheet-feeding roller pair, a pushing member configured to move to the first position to push the small roller onto one of the sheet folding rollers and to the second position remote from the sheet-folding roller pair, and a space located in front of the sheet-folding roller pair.

Any sheet folding apparatus of such a configuration has a single-folding mode and a Z-folding mode. In the single-folding mode, the sheet feeding rollers transport the sheet to a position where the front edge of the sheet hangs in a space. The pushing member is then moved from the second position to the first position, moving the sheet to a position where a prescribed part of the hanging sheet is pressed onto one of the folding rollers. Then, the folding roller pair is driven. That part of the sheet, which is pushed by the small roller, is thereby moved and nipped by the pair of sheet folding rollers. Since said part of the sheet is nipped by the pair of sheet folding rollers, the sheet is thereby held double.

Next, in the Z-folding mode, the sheet folding rollers are stopped while the folding-roller pair is nipping the front edge of the sheet, and the sheet feeding rollers are driven. The sheet therefore slackens, forming a loop in the space. When the loop is formed at the sheet feeding rollers, the sheet feeding rollers are stopped, and the pushing member moves from the second position to the first position. The small roller therefore pushes a prescribed part of the sheet loop from outside thereof, toward the sheet-folding roller pair. A prescribed part of the sheet is therefor moved to a position, where said part of the sheet is pressed onto one of the sheet folding rollers. After the pushing member is moved to the first position, the folding-roller pair is driven again. That part of the sheet, which is pushed onto the folding-roller pair by the small roller, therefore moves and nipped by the pair of sheet folding rollers, forming a second Z-folding line. Thereafter, the sheet folding rollers are driven further. Then, the loop of the sheet in the space becomes smaller gradually, and that part of the loop, which corresponds to the first Z-folding line, is nipped by the sheet-folding roller pair. The sheet is thereby Z-folded, making first Z-holding line.

In the sheet folding apparatuses disclosed in JP 2002-068583 A and JP 2008-207924 A, however, the prescribed part of the sheet pressed onto one of the sheet folding rollers by the small roller warps at its downstream side. This warping of the sheet is not always constant, inevitably changing the position where the sheet is drawn into the sheet folding rollers and nipped between them. Consequently, the position (folding line) where the sheet is single-folded differs from the position (second folding line) where the sheet is Z-folded. Further, that part of the sheet, which is pressed onto the small roller to Z-fold the sheet, is pressed to one of the sheet folding rollers via the front-edge part of the sheet. Inevitably, the sheet slips on the next sheet as it is moved, and the first folding position (first folding line) changes. If the folding position so changes, any sheet folded will have a degraded appearance and will differ from the other sheet in terms of folded state.

SUMMARY OF THE INVENTION

This invention uses, in order to reduce the change of the sheet-folding position, transport rollers, folding rollers, a pushing member, and a guide section. The pushing member is provided between the transport rollers and the folding rollers, and guides a prescribed part of the sheet in a space to the folding-roller pair. The guide section guides any sheet guided by the pushing member to the folding rollers.

DETAILED DESCRIPTION OF THE PREFERRED EMBODIMENTS

A preferred embodiment of this invention will be described, with reference to the accompanying drawings.

[Image Forming System]

Figure 1:
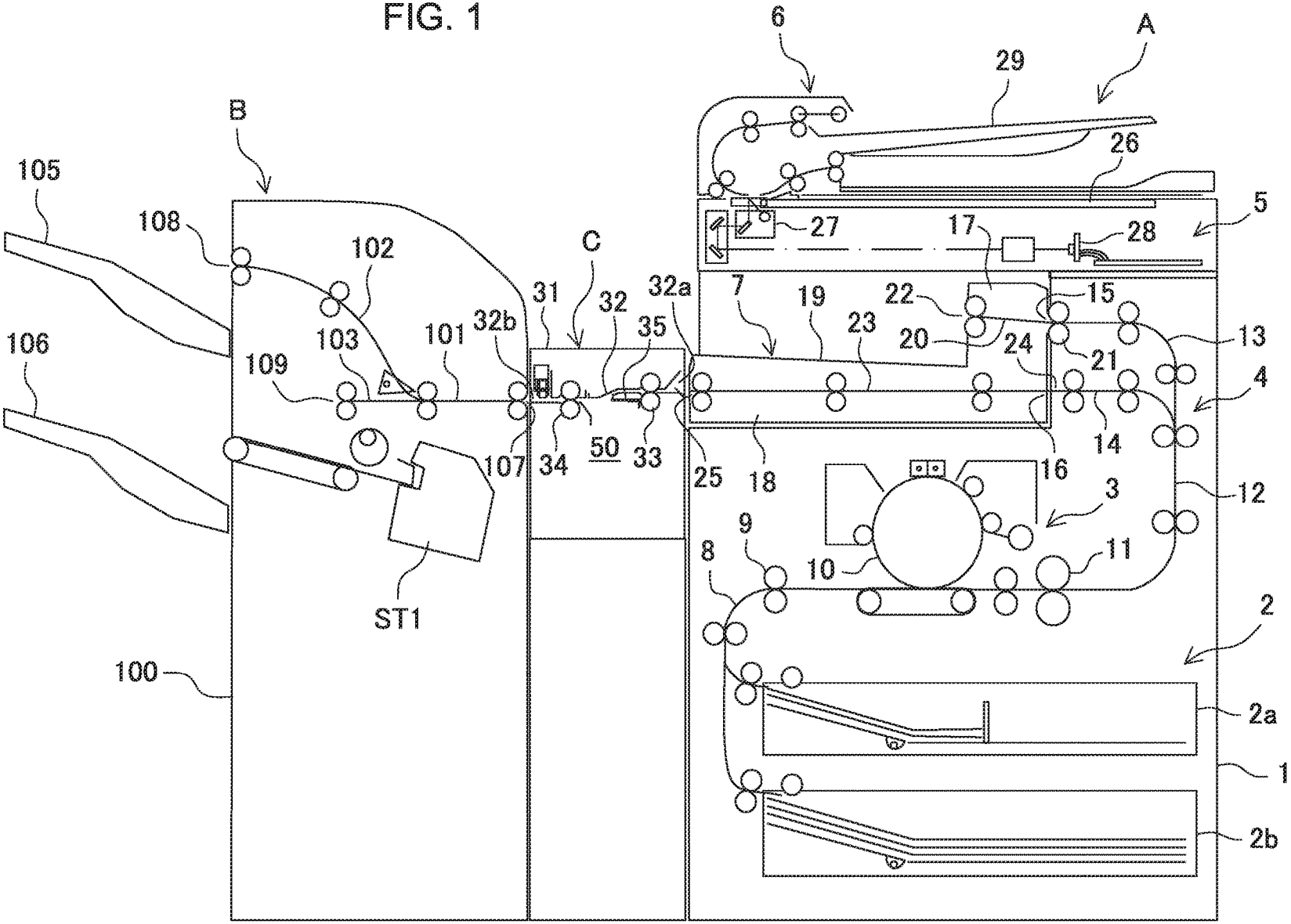
FIG. 1 is an overall configuration diagram of an image forming system utilizing the present invention.

FIG. 1 is an overall configuration diagram of an image forming system utilizing the present invention. The image forming system shown in FIG. 1 comprises an image forming apparatus A, a sheet post-processing apparatus B, and a sheet folding apparatus C coupled between the apparatuses A and B. Any sheet having an image formed in the image forming apparatus A is transported through the sheet folding apparatus C and is ejected onto the ejecting tray of the sheet post-processing apparatus B. Hereinafter, the image forming apparatus A, the sheet post-processing apparatus B and the sheet folding apparatus C will be described.

[Image Forming Apparatus]

The image forming apparatus A is of the type that forms an image on a sheet by using an electrostatic printing mechanism known in the art. The apparatus A has a sheet feeding section 2, an image forming section 3, a sheet ejecting section 4, and a control section (not shown), all provided in an apparatus housing 1. On the housing 1, an image reading section 5 composed of a scanner unit is provided. On the image reading section 5, an automatic document-sheet feeding section 6 is provided, integral with the image reading section 5. The image forming apparatus A according to this embodiment is a so-called internal sheet-ejecting type, and a transport relay unit 7 is arranged in a large front U-shaped sheet-ejecting space defined among the image forming section 3, sheet ejecting section 4 and image reading section 5 shown in FIG. 1. The image forming apparatus A can have, besides the electrostatic printing mechanism, other various image forming mechanisms, such as an ink-jet image forming mechanism, an offset printing mechanism or a silk-screen printing mechanism.

The sheet feeding section 2 has sheet supplying cassettes 2*a* and 2*b*, which hold sheets of one size and sheets of another size, respectively. The cassettes 2*a* and 2*b* can be inserted into, and can be removed from, the housing 1. The sheet feeding section 2 holding sheets, on which images will be formed, feeds a sheet of the size designated by the control section, from the cassette into a sheet supplying passage 8. In the sheet supplying passage 8, registering rollers 9 are provided. The sheet registered, at its front edge, by the registering rollers 9 is supplied, at prescribed timing, to the image forming section 3 which is arranged downstream.

The image forming section 3 has an electrostatic drum 10, and further has a printing head, a developing device, a transfer charger and the like, which are arranged around the electrostatic drum 10. The printing head is composed of, for example, a laser-beam emitter, and forms an electrostatic latent image on the electrostatic drum 10. The developing device applies toner ink to the electrostatic latent image, forming a toner image. The transfer charger transfers the toner image to the sheet. The sheet having the toner image transferred to it is transported to a fixing device 11. The fixing device 11 fixes the toner image by heating and with pressure, and the sheet is transported into the sheet ejecting passage 12 provided in the sheet ejecting section 4.

The sheet ejecting passage 12 branches, at the downstream end, into a first sheet-ejecting passage 13 and a second sheet-ejecting passage 14. The second sheet-ejecting passage 14 is located below the first sheet-ejecting passage 13. The first and second sheet-ejecting passages 13 and 14 are connected to a first ejection port 15 and a second ejection port 16, respectively, which open to the sheet-ejecting space.

The sheet ejecting section 4 may have a sheet circulating passage (not shown). The sheet circulating passage connects the sheet ejecting passage 12 to the sheet supplying passage 8 at, for example, a position upstream the registering rollers 9. The sheet supplied from the image forming section 3 and therefore having an image is switched back into the sheet circulating passage by rotating the sheet ejecting rollers provided in the sheet ejecting passage 12. The sheet is thereby turned upside down and is then transported again to the image forming section 3. Images can therefore be formed on both sides of the sheet.

As illustrated in FIG. 1, the transport relay unit 7 is shaped, substantially in the form of letter L as viewed from front, and has a first relay part 17 and a second relay part 18. The first relay part 17 extends, at the right end, upwards in the sheet-ejecting space. In the sheet-ejecting space, the second relay part 18 extends to the left side of the housing 1, substantially over the entire lateral width of the space. The upper surface of the second relay part 18 defines a sheet-ejected tray 19 which is generally flat in the sheet-ejecting space.

The first relay unit 17 has a first relay passage 20 in it. The first relay passage 20 has a first sheet inlet port 21 and a first sheet outlet port 22. The first sheet inlet port 21 is connected to the first ejection port 15 of the sheet ejecting section 4. The first sheet outlet port 22 is arranged and opens to the sheet-ejecting space, above the sheet-ejected tray 19. At the first relay passage 20, transport rollers are provided near the first sheet outlet port 22 and are driven by a motor incorporated in the first relay part 17. The sheet having an image formed on it and transported from the sheet ejecting section 4 through the first sheet-ejecting passage 13 is transported by the transport rollers, passes through the first relay passage 20 and is transported onto the sheet-ejected tray 19.

The second relay part 18 incorporates a second relay passage 23. The second relay passage 23 has second sheet inlet port 24, which is connected to the second ejection port 16 of the sheet ejecting section 4. The second sheet outlet port 25 of the second relay passage 23 opens, almost in flush with the left side surface of the apparatus housing 1, and is connected to the sheet inlet port of the sheet folding apparatus C as will be described later. In the second relay passage 23, a plurality of rollers are arranged. These rollers are driven by a motor incorporated in the second relay part 18, and transport the sheet. The sheet transported from the sheet ejecting section 4 via the second sheet-ejecting passage 14 and having an image formed on it is transported by the transport rollers to the sheet folding apparatus C through the second relay passage 23.

The image reading section 5 comprises a platen 26 configured to hold a document sheet, a reading carriage 27 configured to move along the platen, and an optical reading unit 28 composed of, for example, a CCD device. The reading carriage 27 scans the document sheet placed on the platen 26, optically reading the document sheet. The optical image thereby generated is opto-electrically converted to image data by the optical reading unit 28. The document-sheet feeding section 6 automatically feeds a document sheet from a sheet supply tray 29 to the platen 26.

In the image forming apparatus A configured as described above, the image reading section 5 reads a document sheet fed from the document-sheet feeding section 6, and the image forming section 3 forms an image on the basis of the image data read by the image reading section 5. If the sheet having the image formed on it need not be folded by the sheet folding apparatus C or be post-processed by the sheet post-processing apparatus B, it is transported from the sheet ejecting section 4 through the first sheet-ejecting passage 13, then passes through the first relay passage 20, and is transported onto the sheet-ejected tray 19 provided in the sheet-ejecting space. If the sheet having the image formed on it need be folded and/or post-processed, it is transported from the sheet ejecting section 4 through the second sheet-ejecting passage 14, then passes through the second relay passage 23 and is sent to the sheet folding apparatus C.

[Sheet Post-Processing Apparatus]

As shown in FIG. 1, the sheet post-processing apparatus B comprises first to third transport paths 101, 102 and 103, a post-process device, and a binding-process tray 104, all provided in the housing 100. Through the first transport path 101, any sheet coming from the sheet folding apparatus C is transported. The second transport path 102 and the third transport path 103 branch from the first transport path 101. The post-process device is, for example, a staple unit ST1. On one side (left side in FIG. 1) of the housing 100, a first ejected-sheet tray 105 and a second ejected-sheet tray 106 are provided, spaced apart in the vertical direction, to receive and accumulate the sheets ejected from the sheet post-processing apparatus B. The sheet post-processing apparatus B is so arranged that the sheet-inlet port 107 of the first transport path 101 is connected to the sheet-outlet port of the sheet folding apparatus C (described later).

The first ejected-sheet tray 105 is arranged below the sheet-outlet port 108 of the second transport path 102, which opens in said side of the housing 100. Any sheet sent from the sheet folding apparatus C is transported from the first transport path 101 onto the second transport path 102 and ejected through the sheet-outlet port 108 onto the first ejected-sheet tray 105 if the staple unit ST1 does not perform a stapling process and/or any other post-process.

The sheet-outlet port 109 of the third transport path 103 is positioned above the binding-process tray 104, opposing the sheet-mounting surface of the binding-process tray 104. To be stapled together by the staple unit ST1, the sheets sent from the sheet folding apparatus C are transported from the first transport path 101 to the third transport path 103 and are ejected from the sheet-outlet port 109 of the path 103 onto the sheet holding surface of the binding-process tray 104. The sheets accumulated on the binding-process tray 104 are stapled together, forming a sheet bundle, by the staple unit ST1. The sheet bundle is transported from the binding-process tray 104 to the second ejected-sheet tray 106 located downstream the binding-process tray 104.

[Overall Configuration of the Sheet Folding Apparatus]

Figure 2:
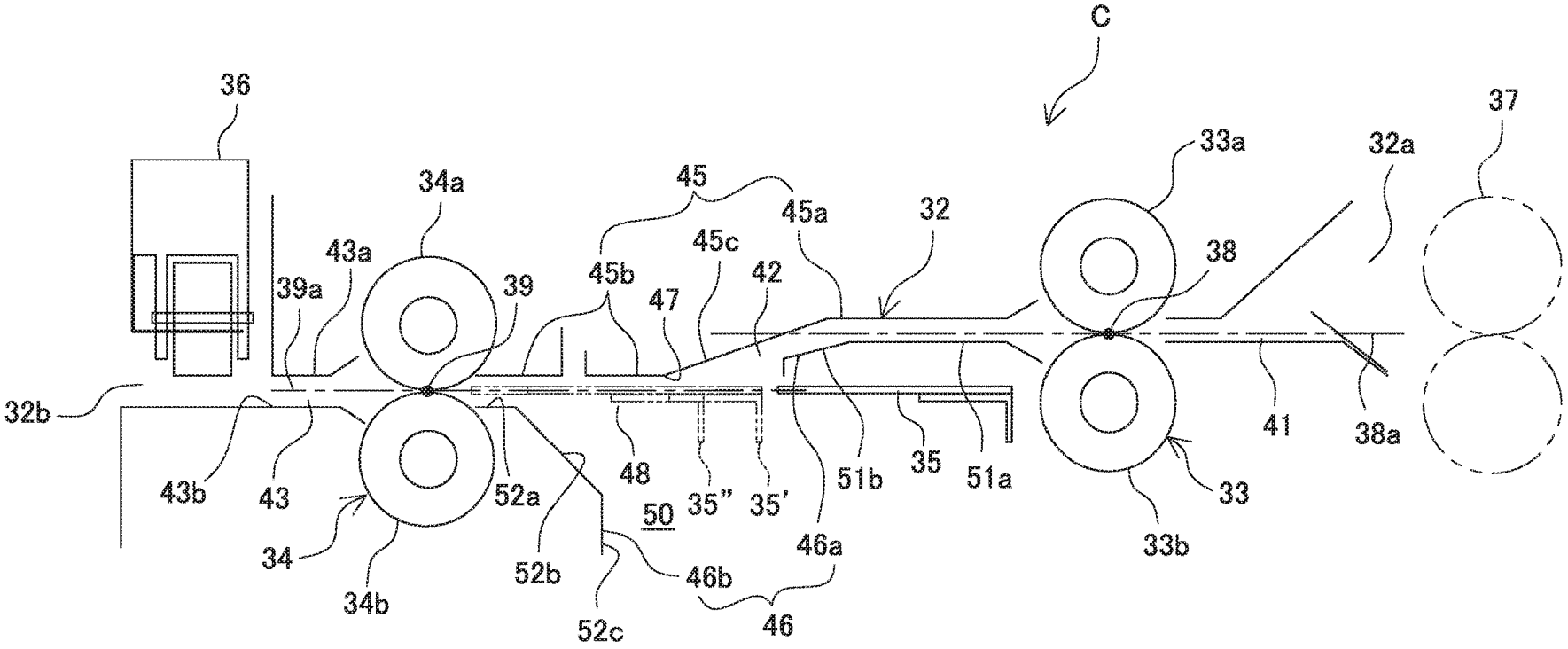
FIG. 2 is a schematic diagram of a sheet folding apparatus according to the present invention.

As shown in FIG. 2, the sheet folding apparatus C has a housing 31 and a transport path 32 provided in the housing 31. The transport path 32 extends from the sheet-inlet port 32*a* of the image forming apparatus A to the sheet-outlet port 32*b* of the sheet post-processing apparatus B. At the transport path 32, a registering-roller pair 33 and a folding-roller pair 34 are arranged, respectively at upstream and downstream parts, in the sheet transporting direction, and a pushing plate 35 is arranged between the roller pairs 33 and 34. The sheet folding apparatus C is so configured that, as described above, the sheet-inlet port 32*a* is connected to the second sheet outlet port 25 of the transport relay unit 7 provided in the image forming apparatus A and the sheet-outlet port 32*b* is connected to the sheet-inlet port 107 of the sheet post-processing apparatus B.

Further, an additional-folding mechanism 36 may be provided, as an optional component, near the sheet-outlet port 32*b* of the transport path 32. It has been well known to anyone skilled in the art that in a folding apparatus such as the sheet folding apparatus C, an additional-folding mechanism for pressing the sheet at a position downstream the sheet-folding section is used in order to fold the sheet reliably at the sheet-folding position.

[Registering-Roller Pair]

The registering-roller pair 33 is composed of a driving roller 33*a* and a driven roller 33*b*, which are arranged above and below the transport path 32, respectively. The driven roller 33*b* has its surface pressed to the surface of the driving roller 33*a* by, for example, an appropriate spring unit (not shown). Therefore, the driven roller 33*b* is rotated if the driving roller 33*a* is driven by a registering motor which will be described later.

The sheet transported from the transport relay unit 7 of the image forming apparatus A by an ejecting roller pair 37 provided near the second sheet outlet port 25 has its front edge abut on a nip part 38 of the registering-roller pair 33 not rotating. The sheet therefore is registered at its front edge. The sheet having its front edge so registered is transported toward the folding-roller pair 34 through the transport path 32, as the registering-roller pair 33 is driven at a prescribed timing.

In an another embodiment, the registering-roller pair 33 can be replaced by ejecting rollers (equivalent to the ejecting roller pair 37) which eject the sheet from the image forming apparatus A to the sheet folding apparatus C. This reduces the number of components constituting the sheet folding apparatus C, lowering the manufacturing cost and rendering the apparatus C shorter in the sheet transporting direction. In this case, the ejecting roller pair 37 should better have a function of aligning the sheet transported to the transport path 32, at its front edge, as described above.

[Folding-Roller Pair]

The folding-roller pair 34 consists of an upper folding roller 34*a* and a lower folding roller 34*b* provided across the transport path 32. The rollers 34*a* and 34*b* are pressed to each other, at their surfaces, by an appropriate spring unit (not shown), nip the front edge and folding line of each sheet transported from the registering-roller pair 33 and fold the sheet. Further, the rollers 34*a* and 34*b* pressed to each other are driven, in unison, by a folding-roller drive motor described later, and rotate to transport the sheet.

The folding-roller pair 34 is arranged above the tangential line 39*a* passing a nip part 39 where the rollers press each other, positioning the nip 38 of the registering-roller pair 33 above the tangential line 39*a*. In the embodiment of FIG. 2, the tangential line 39*a* and the tangential line 38*a* passing the nip part 38 of the registering-roller pair 33 are almost horizontal at different heights, the tangential line 38*a* located above the tangential line 39*a*.

[Transport Path]

As shown in FIG. 2, the transport path 32 is composed of a sheet inlet path 41 which extends from the sheet-inlet port 32*a* to the registering-roller pair 33, a center path 42 which extends from the registering-roller pair to the folding-roller pair 34, and a sheet outlet path 43 which extends from the folding-roller pair 34 to the sheet-outlet port 32*b*.

The sheet inlet path 41 has an upper inlet guide 41*a* and a lower inlet guide 41*b* which are arranged one above the other and extend in the sheet transport direction and which guides the front edge of the sheet to the nip part 38 of the registering-roller pair 33. The upper inlet guide 41*a* greatly flares out upwards from the point near the registering-roller pair 33 toward the inlet side to provide a space large enough to allow the sheet to warp and form a loop as it is transported from the upstream side to the ejecting roller pair 37, as the front edge of the sheet abuts on the nip part 38 of the registering-roller pair 33 and is thereby aligned.

As shown in FIG. 2, the center path 42 has an upper transport guide 45 and a lower transport guide 46 which extend in the sheet transport direction and which are arranged, one above the other, in order to guide the sheet, aligned at front edge by the registering-roller pair 33, to the nip part 39 of the folding-roller pair 34. The sheet is transported through the center path 42, while being restricted, at with both sides in the thickness direction, by the upper and lower transport guides 45 and 46.

As described above, the tangential line 38*a* passing the nip part 38 of the registering-roller pair 33 and the tangential line 39*a* passing the nip part 39 of the registering-roller pair 34 extend parallel to each other and are arranged one above the other. Therefore, the upper transport guide 45 has a first horizontal part 45*a* horizontally extending downstream along the tangential line 38*a*, a second horizontal part 45*b* horizontally extending upstream along the tangential line 39*a*, and an inclining part 45*c* extending downward from the upstream side to the downstream side as if connecting the tangential lines 38*a* and 39*a*.

As shown in FIG. 2, the inclining part 45*c* is formed, linearly extending upward and slantwise, from the upstream end of the second horizontal part 45*b* toward the upper-right corner of FIG. 2. The inclining part 45*c* and the second horizontal part 45*b* extend straight and intersect with each other. At the position where the parts 45*c* and 45*b* intersect, there is formed a protrusion 47 having a relatively large obtuse angle and extending almost downward from the center path 42. Similarly, the part connecting the inclining part 45*c* and the first horizontal part 45*a* has a relatively large obtuse angle.

In another embodiment, the part connecting the inclining part 45*c* and the second horizontal part 45*b* may be curved. In this case, the protrusion 47 is shaped, protruding almost downward from the center path 42. The part connecting the inclining part 45*c* and the first horizontal part 45*a* may be curved similarly. In still another embodiment, the second horizontal part 45*b* and inclining part 45*c* of the upper transport guide 45 may be separate members, and may constitute the protrusion 47.

In this embodiment, as shown in FIG. 2, the upstream parts of the first horizontal part 45*a*, inclining part 45*c* and second horizontal part 45*b* are formed of a single member, i.e., first upper transport guide member. The downstream part of the second horizontal part 45*b* is formed of a second upper transport guide member. The first and second upper transport guide members are arranged, substantially connected to each other, not to make any trouble in the sheet transport in the center path 42. Further, the first upper transport guide member can be composed of a plurality of guide members which are substantially continuous to one another. Still further, the junction of the first and second upper transport guide members can be provided at various positions other than the position shown in FIG. 2.

The lower transport guide 46 has a first lower guide part 46*a* and a second lower guide part 46*b*. The first lower guide part 46*a* extends in the downstream direction, from the registering-roller pair 33 to a prescribed position in the sheet transporting direction. The second lower guide part 46*b* extends in the upstream direction, from the folding-roller pair 34 to a prescribed position in the sheet transporting direction. The first lower guide part 46*a* and the second lower guide part 46*b* are secured to the housing 31, defining, between them, a large space 48 extending in the sheet transporting direction. The space 48 between the first lower guide part 46*a* and the second lower guide part 46*b* can be opened and closed by the pushing plate 35 which can horizontally move toward or retreats from the nip part 39 of the folding-roller pair 34 as will be described later.

As shown in FIG. 2, a relatively large loop-forming space 50 is provided below the space 48 of the lower transport guide 46. If the pushing plate 35 retreats (see solid lines in FIG. 2), opening the space 48, the sheet in the center path 42 can hang from the space 48 into the loop-forming space 50. The pushing plate 35 may move forward (see broken lines 35' in FIG. 2), closing the space 48. In this case, the sheet transported from the registering-roller pair 33 can be transported toward the folding-roller pair 34 along the center path 42, without hanging in the loop-forming space 50.

The first lower guide part 46*a* has a first horizontal guide part 51*a* and a first inclining guide part 51*b*. The first horizontal guide part 51*a* extends horizontally from the registering-roller pair 33 to the downstream side, while opposing the first horizontal part 45*a* of the upper transport guide 45. The first inclining guide part 51*b* extends downward, from the first horizontal guide part 51*a*, almost parallel to the middle part of the inclining part 45C of the upper transport guide 45. The downstream end of the first inclining guide part 51*b* defines the hanging start position of sheet when the space 48 is opened. In this embodiment, the lower end of the first inclining guide part 51*b* is located above the tangential line 39*a* extending through the nip part 39 of the folding-roller pair 34.

The second lower guide part 46*b* is composed of a second horizontal guide part 52*a* (first transport guide member), a second inclining guide part 52*b* (second restriction guide member), and a vertical guide part 52*c* (first restriction guide member). The second horizontal guide part 52*a* horizontally extends from the folding-roller pair 34 in upstream direction. The second inclining guide part 52*b* inclines downwards, from the second horizontal guide part 52*a*. The vertical guide part 52*c* extends downward, almost vertically, from the second horizontal guide part.

The second horizontal guide part 52*a* cooperates with the second horizontal part 45*b* of the upper transport guide 45, and guides the front edge of the sheet to the nip part 39 of the folding-roller pair 34, while restricting the sheet at both side in the thickness direction, namely the vertical direction. The second inclining guide part 52*b* inclines toward the loop-forming space 50, to guide the sheet hanging in the loop-forming space 50, into the nip part 39. The second inclining guide part 52*b* cooperates with the vertical guide part 52*c*, isolating the sheet hanging in the loop-forming space 50 from the folding-roller pair 34, while maintaining a sufficient size of the loop-forming space. That is, the second inclining guide part 52*b* and the vertical guide part 52*c* are arranged in the loop-forming space 50 located below the space 48 of the lower transport guide 46, and functions as a loop guide unit 53 for restricting the upstream part of the sheet loop hanging in the loop-forming space 50. In this embodiment, the second horizontal guide part 52*a*, second inclining guide part 52*b* and vertical guide part 52*c* of the second lower guide part 46*b* are provided on one lower transport guide member. Instead, they may be provided on three members, respectively.

While the pushing plate 35 remains in the retreat position (described later), the sheet transported from the registering-roller pair 33 to the center path 42 may move beyond the downstream end of the first inclining guide part 51*b*. In this case, the sheet transported from the registering-roller pair 33 to the center path 42 hang down linearly, first at its front edge, through the open space 48 into the loop-forming space 50. If the space 48 is opened while the front edge of the sheet remains nipped by the folding-roller pair 34 and the folding-roller pair 34 are stopped, the sheet in the center path 42 is curved and hangs down, in the shape of a loop, through the space 48 into the loop-forming space 50.

In other words, the center path 42 is composed of a first passage part which transports the sheet from the registering-roller pair 33, a second passage part which can selectively connect the center path 42 to the loop-forming space 50, and a third passage part which guides the sheet to the nip part 39 of the folding-roller pair 34. The first to third passage parts are practically connected in the sheet transporting direction by the upper transport guide 45 composed of the first and second upper transport guide members. At the lower surface of the sheet, the first passage part is composed of the first lower guide part 46*a* secured in position, and the third passage part is composed of the second lower guide part 46*b* secured in position. By contrast, the second passage part is composed of the space 48 which can be opened and closed by moving the pushing plate 35.

In another embodiment, the first passage part may be composed of only a horizontal guide part, not using the first inclining guide part 51*b*. As shown in FIG. 2, the upper transport guide 45 is designed such that the junction of the inclining part 45*c* and second horizontal part 45*b* is located in the space 48 of the second passage part. The invention is not limited to this. The second inclining guide part 52*b* may be made smaller than shown in FIG. 2 or may not be used so long as the sheet hanging down into the loop-forming space 50 is guided to the nip part 39 of the folding-roller pair 34. The vertical guide part 52*c* can therefore be made smaller or may not be used at all, provided that the loop-forming space 50 is sufficiently large.

The sheet outlet path 43 has an upper transport guide 43*a* and a lower transport guide 43*b* which are arranged in the sheet transporting direction and one above the other, in order to guide any sheet folded to the sheet-outlet port 32*b*. In front of the sheet-outlet port 32*b*, an additional-folding mechanism 36 is provided. The mechanism 36 has a plurality of rolling members that move on the lower transport guide 43*b* in, for example, a direction which intersects with the sheet widthwise direction, thereby to further fold the sheet that has been folded already.

[Pushing Plate]

As show in FIGS. 2 and 3, the pushing plate 35 is made of a flat plate that extends in the sheet widthwise direction of the center path 42. The pushing plate 35 is arranged horizontal and at almost the same height as the nip part 39 of the folding-roller pair 34. The pushing plate 35 is arranged, able to move in horizontal direction to a retreat position (indicated by solid lines in FIG. 2) below the first lower guide part 46*a*, and between a guiding position (indicated by broken lines 35' in FIG. 2) and a pushing position (indicated by broken lines 35" in FIG. 2).

While the pushing plate 35 remains at the retread position, the space 48 of the lower transport guide 46 fully opens, and the center path 42 therefore has its second passage part opened to the loop-forming space 50 located below. The sheet in the center path 42 can therefore hang down in the loop-forming space 50.

At the guiding position indicated by the broken lines 35', the pushing plate 35 completely closes the space 48 of the lower transport guide 46, opposes the upper transport guide 45 in the vertical direction at the same time, and forms a part of the lower transport guide 46. The sheet is guided from the center path 42 into the second passage part, without hanging down in the loop-forming space 50. Then, the sheet is transported from the first passage part to the third passage part.

While remaining at the pushing position indicated by broken lines 35", the pushing plate 35 enters the gap between the second horizontal part 45*b* of the upper transport guide 45 and the second horizontal guide part 52*a* of the second lower guide part 46*b* in the third passage part. This pushing position is a position where the pushing plate 35 moves the folding line of the sheet to the nip part 39 of the folding-roller pair 34.

Figure 3A:
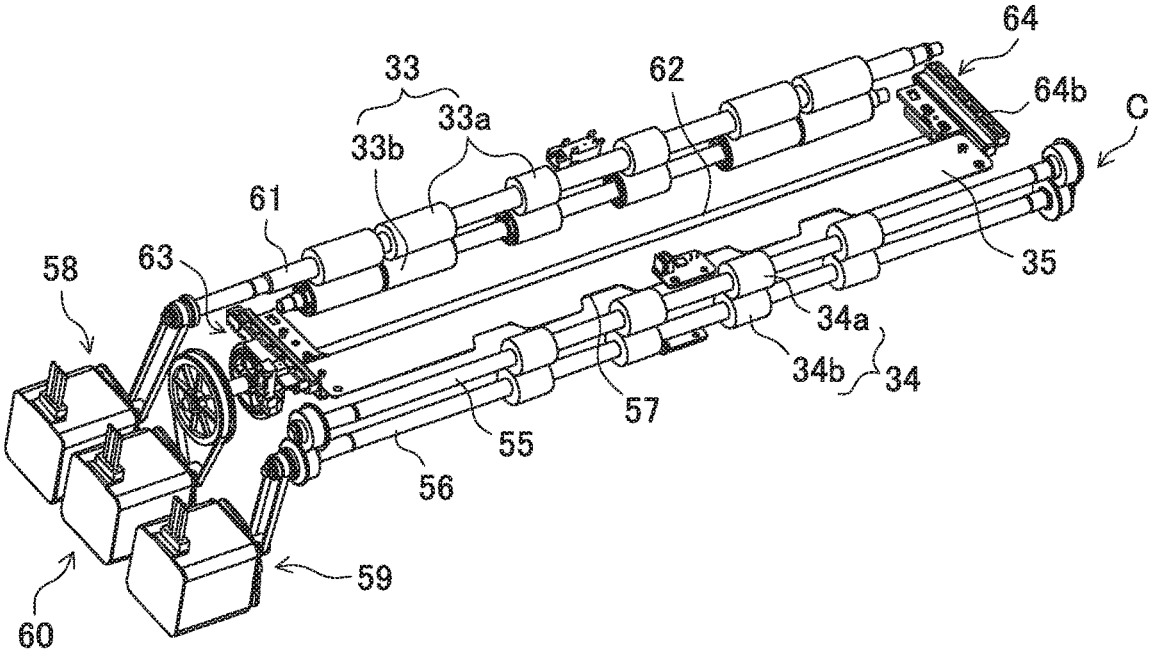
FIG. 3A is a perspective view of the entire drive mechanism of the sheet folding apparatus.
Figure 3B:
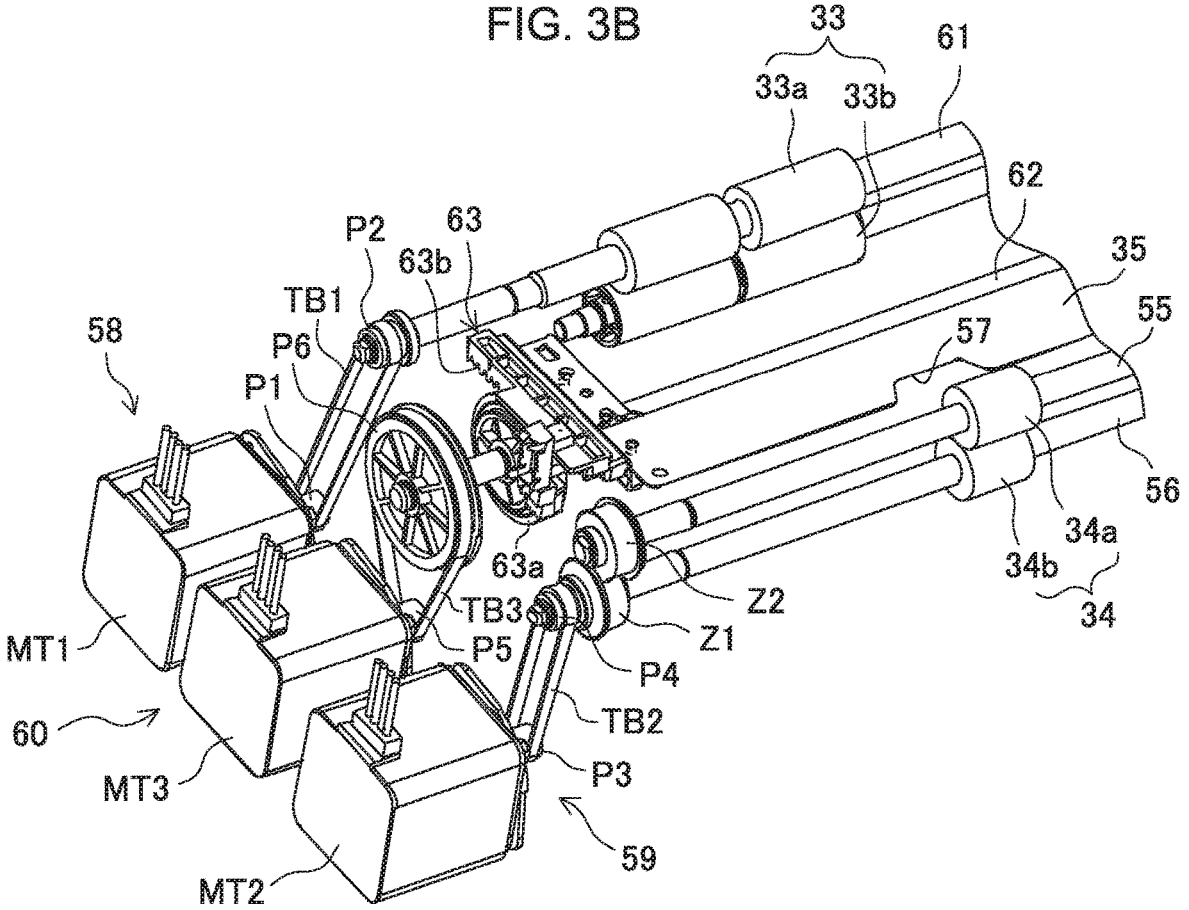
FIG. 3B is an enlarged view of the major parts of the drive mechanism.

FIGS. 3A and 3B show the configuration of the pushing plate 35, in more detail. As these figures show, the four folding roller pairs, each composed of lower folding rollers 34*a* and 34*b*, are mounted on an upper roller shaft 55 and a lower roller shaft 56 in this embodiment. Of the four roller pairs, two pairs are arranged symmetric to the other two pairs with respect to the middle parts of the roller shafts 55 and 56 in the axial direction thereof. The front edge of the pushing plate 35 has four notches 57 arranged in the sheet widthwise direction. The notches 57 are positioned at the associated folding-roller pairs 34, respectively, each having shape and size corresponding to those of the associated folding-roller pair 34.

The pushing plate 35 is moved to the retread position and between the guiding position and the pushing position, by the pushing-plate drive motor M3 provided in a drive mechanism shown in FIG. 3. The pushing-plate drive motor M3 is driven and controlled by a control section 120 shown in FIG. 5, as will be described hereinafter.

[Drive Mechanism in the Sheet Folding Apparatus]

FIGS. 3A and 3B show drive mechanisms 58 to 60 for driving the registering-roller pair 33, folding-roller pair 34 and pushing plate 35, respectively, in the sheet folding apparatus C. The registering-roller pair 33 is provided, allowing the driving roller 33*a* to rotate together with a roller shaft 61 that can rotate in the sheet-width direction. The folding-roller pair 34 is composed of an upper folding roller 34*a* and a lower folding roller 34*b*. The upper and lower folding rollers 34*a* and 34*b* are mounted on the roller shafts 55 and 56, respectively, which are provided so as to be rotatable in the sheet widthwise direction and can rotate as the roller shafts 55 and 56 are rotated.

The drive mechanism 58 for driving the registering-roller pair 33 comprises a registering-roller drive motor MT1, a drive pulley P1 mounted on the shaft of the registering-roller drive motor MT1, a driven pulley P2 mounted on one end of the roller shaft 61 of the driving roller 33*a*, and a timing belt TB1 wrapped around both pulleys P1 and P2. The drive force of the registering-roller drive motor MT1 is transmitted from the shaft of the registering-roller drive motor MT1 to the driving roller 33*a* through the transmission mechanism composed of the drive pulley P1, timing belt TB1 and driven pulley P2.

A drive mechanism 59 for driving the folding rollers 34 comprises a folding-roller drive motor MT2, a driving pulley P3 mounted on the shaft of the motor MT2, a driven pulley P4 mounted on the roller shaft 56 of the lower folding roller 34*b*, and a timing belt TB2 wrapped around both pulleys P3 and P4. The drive mechanism 59 further comprises gears Z1 and Z2. The gear Z1 is mounted coaxially on the roller shaft 56, and can rotate as the roller shaft 56 is driven. The gear Z2 is mounted coaxially on the roller shaft 55, and can rotate as the roller shaft 55 of the upper folding roller 34*a* is driven.

The drive force of the folding-roller drive motor MT2 is transmitted from the shaft of the motor MT2 to the lower folding roller 34*b* through the transmission mechanism composed of the driving pulley P3, timing belt TB2 and driven pulley 4. Further, the drive force of the folding-roller drive motor MT2 is transmitted from the roller shaft 56 having the driven pulley P4 to the upper folding roller 34*a* through the gears Z1 and Z2 which are in mesh with each other. The upper folding roller 34*a* and the lower folding roller 34*b* therefore rotate at the same time in opposite directions, and can cooperate to transport the sheet nipped by the rollers 34*a* and 34*b* in the sheet transporting direction.

The drive mechanism 60 for driving the pushing plate 35 comprises the pushing-plate drive motor M3, a driving pulley P5, a rotary shaft 62, a driven pulley P6, a timing belt TB3, a first rack-pinion mechanism 63, and a second rack-pinion mechanism 64. The driving pulley P5 is mounted on the shaft of the pushing-plate drive motor M3. The rotary shaft 62 extends in the sheet widthwise direction. The driven pulley P6 is mounted on one end of the rotary shaft 62. The timing belt TB3 is wrapped around both pulleys P5 and P6. The first rack-pinion mechanism 63 is arranged at one end of the rotary shaft 62 and located inner than the driven pulley P6. The second rack-pinion mechanism 64 is provided at the other end of the rotary shaft 62.

The first rack-pinion mechanism 63 has a first pinion 63*a* and a first rack 63*b*. The first pinion 63*a* is mounted on one end of the rotary shaft 62, positioned more inner than the driven pulley P6, and can rotate as the shaft 62 is driven. The first rack 63*b* is provided on one end of the pushing plate 35 and meshes with the first pinion 63*a*. Similarly, the second rack-pinion mechanism 64 has a second pinion 64*a* and a second rack 64*b*. The second pinion 64*a* is mounted on the other end of the rotary shaft 62, and can rotate as the shaft 62 is driven. The second rack 64*b* is provided on the other end of the pushing plate 35 and meshes with the second pinion 64*a*. The first and second racks 63*b* and 64*b* are arranged so that the pushing plate 35 synchronously moves in the same direction to move the first and second pinions 63*a* and 64*a* in the horizontal direction.

The drive force of the pushing-plate drive motor M3 is transmitted from the shaft thereof to the first pinion 63*a* and second pinion 64*a* through the transmission mechanism composed of the driving pulley P5, timing belt TB3 and driven pulley P6. Therefore, the first and second racks 63*b* and 64*b* move synchronously in the same direction, and move the pushing plate 35 in the horizontal direction.

[Control System in the Sheet folding Apparatus]

Figure 5:
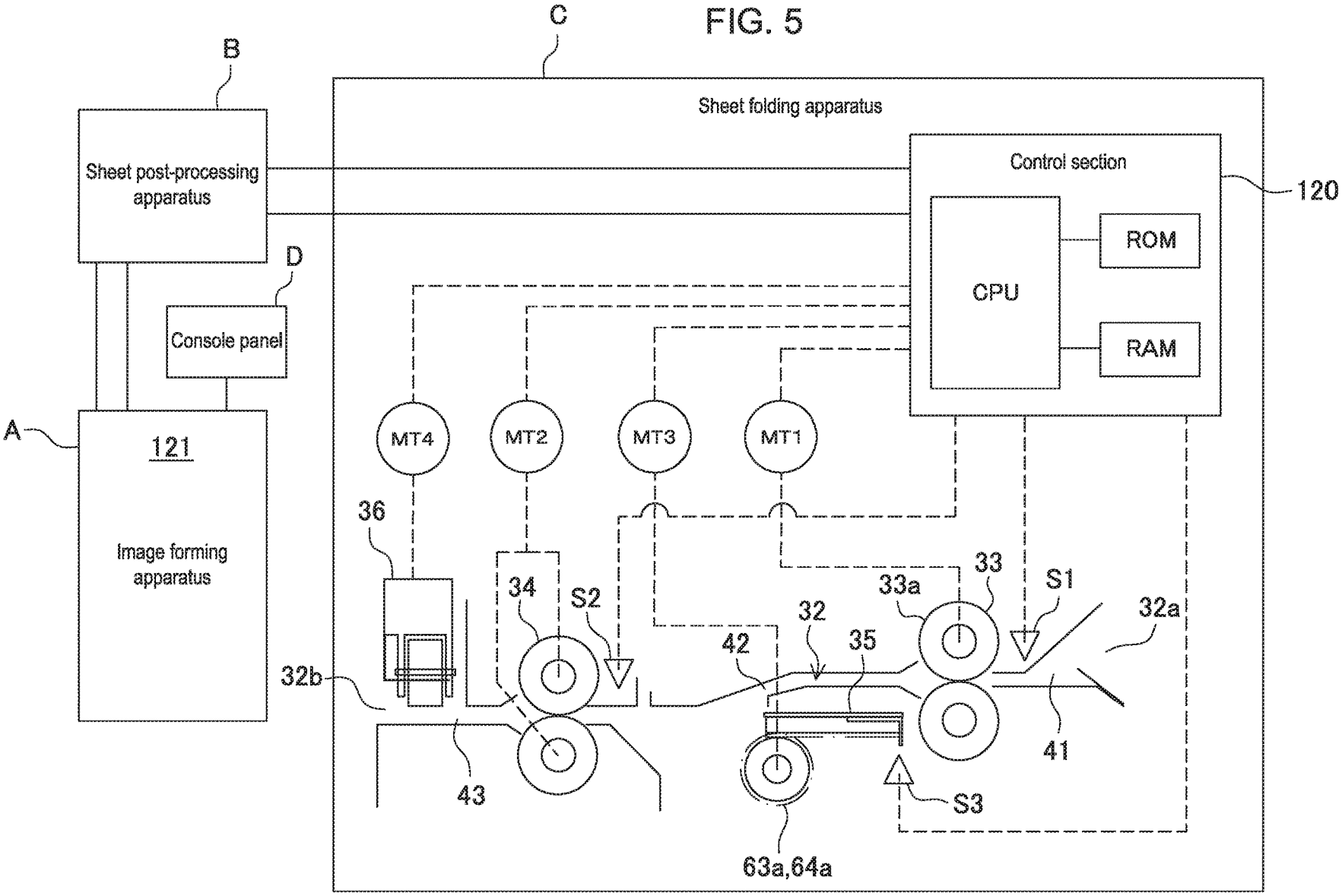
FIG. 5 is a block diagram showing the control system of the sheet folding apparatus.

FIG. 5 schematically shows the control system of the sheet folding apparatus C. The sheet folding apparatus C comprises a control section 120 composed of a control board that includes a CPU. As shown in FIG. 5, the control section 120 has first to third detection sensors S1, S2 and S3 which are arranged along the transport path 32.

The first detection sensor S1 is arranged in front of the registering-roller pair 33 of the sheet inlet path 41, and detects the front edge of the sheet transported from the image forming apparatus A through the sheet-inlet port 32*a*. The second detection sensor S2 is arranged in front of the folding-roller pair 34 of the center path 42, and detects the front edge of the sheet transported from the registering-roller pair 33 to the folding-roller pair 34. The third detection sensor S3 detects the position of the pushing plate 35 moving to the retreat position, the guiding position or the pushing position. The outputs of the first to third detection sensors S1 to S3 are supplied to the control section 120 in real time.

The control section 120 is connected to the control section 121 of the image forming apparatus A, by the sheet post-processing apparatus B. The control section 121 is connected to the input section (not shown) and the display section (not shown), both incorporated in the console panel D of the image forming apparatus A. The data, such as the sheet type the user has set on the console panel D of the image forming apparatus A, and the data, such as the sheet-folding mode in which to operate the sheet folding apparatus C are transmitted from the control section 121 to the control section 120 through the sheet post-processing apparatus B.

The CPU of the control section 120 executes the program stored in a ROM, and controls the drive motors MT1, MT2 and MT3 and an additional-folding motor MT4 for driving the additional-folding mechanism 36. That is, the CPU of the control section 120 executes the program stored in the ROM, and controls the drive motors MT1, MT2, MT3 and MT4. On the basis of the outputs from the first to third detection sensors 51 to S3 and the various data items received from the control section 121 of the image forming apparatus A, the drive motors MT1 to MT4 are controlled, thereby controlling the sheet transportation in the transport path 32 and the sheet-folding process in the sheet folding apparatus C.

The control section 120 can transmit, in real time, the information about the sheet transportation and sheet folding, both performed in the sheet folding apparatus C, to the control section 121 of the image forming apparatus A through the post-processing apparatus B. If the information received from the control section 120 contains alarm data or undesirable data representing sheet-transportation error or insufficient sheet folding, the alarm or the undesirable data can be displayed at, for example, the display unit of the console panel D.

Figure 4:
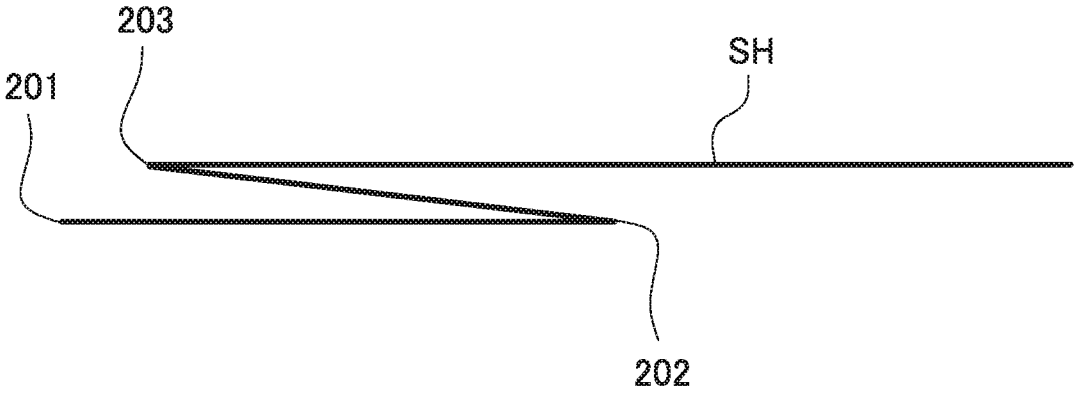
FIG. 4 is an end view illustrating a sheet that has been three-folded (i.e., Z-folded) by the sheet folding apparatus.

The sheet folding apparatus C according to the present embodiment can fold a sheet along two parallel lines along the sheet transporting direction to achieve the so-called Z-folding. FIG. 4 illustrates a sheet Z-folded by the sheet folding apparatus C, as viewed in the sheet widthwise direction. As shown in FIG. 4, the sheet SH has a first folding line 202 at a preset distance from the front edge 201 (downstream edge) in the sheet widthwise direction, and a second folding line 203 at a preset distance from the first folding line 202 in the downstream direction.

[Sheet-Folding Process in the Sheet Folding Apparatus]

How the sheet folding apparatus C folds a sheet will be described hereinafter. A Z-folding mode of folding a sheet along two lines and a non-folding mode of not folding a sheet at all are preset in the sheet folding apparatus C. Before starting the image-forming process in the image forming apparatus A, the user determines which process, the image-forming process or the sheet-folding process, should be performed. To perform the sheet-folding process, the sheet-folding mode is selected and input at the console panel D. The sheet-folding mode is stored, as information about the sheet subject to folding process, in the control section 121 of the image forming apparatus A.

Figure 6:
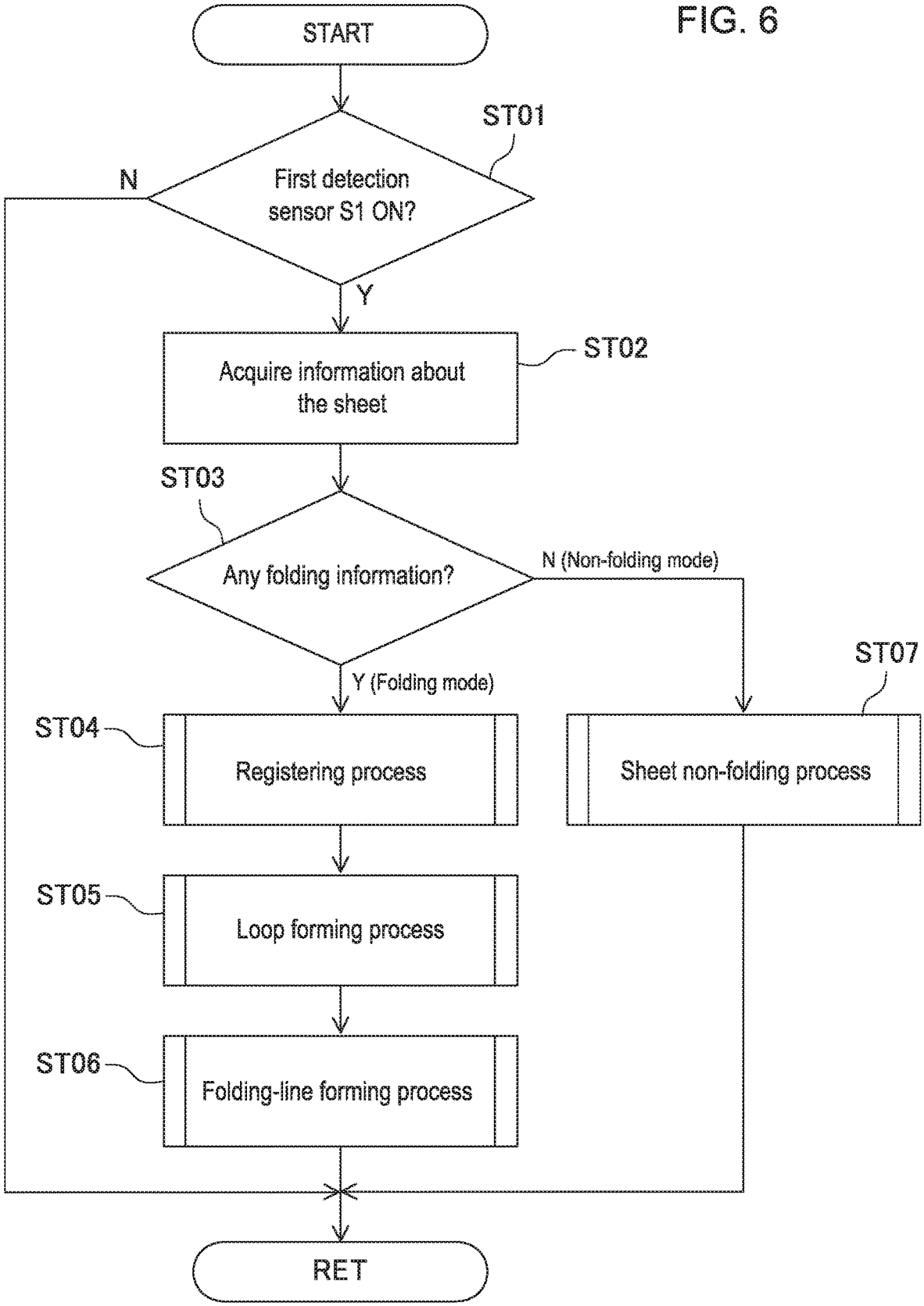
FIG. 6 is a flowchart explaining the sequence of sheet-folding steps performed in the sheet folding apparatus.

How the sheet folding apparatus C operates will be explained briefly, with reference to the flowchart of FIG. 6. First, if the first detection sensor S1 detects the front edge of the sheet transported to the sheet inlet path 41 (if Y in Step ST1), the control section 120 of the sheet folding apparatus C uses the output of the sensor S1 as trigger, acquiring the information about the sheet from the control section 121 of the image forming apparatus A through the sheet post-processing apparatus B (Step ST02).

If the sheet information acquired from the control section 121 of the image forming apparatus A contains the instruction of performing the selection of the folding mode or the instruction of performing the sheet-folding process (Y in Step ST03), the operation proceeds to Step ST04, performing the sheet folding process. Alternatively, the sheet information acquired may not contain the instruction of performing the selection of the folding mode or the instruction of performing the sheet-folding process or may contain the instruction of not performing the sheet-folding process. If this is the case, the process goes to Step ST07, and no sheet folding is performed.

In Step ST07 (performing sheet non-folding), the pushing plate 35 is positioned in the guiding position (indicated by broken lines 35'), and the registering-roller pair 33 and the folding-roller pair 34 are rotated. Therefore, the sheet transported from the image forming apparatus A passes through the transport path 32 without being folded and transported to the sheet post-processing apparatus B.

The sheet-folding process starting in Step ST04 is performed in three steps, i.e., the registering process (Step ST04) performed by the registering-roller pair 33, the loop forming process (Step ST05) performed by the folding-roller pair 34, and the folding-line forming process (Step ST06) performed by the pushing plate 35 and folding-roller pair 34. In the registering process, the sheet transported into the sheet folding apparatus C is registered at its front edge, eliminating the sheet skew (sheet inclination). In the loop forming step, the front edge of the sheet is looped in order to make a folding line. In the folding-line forming step, the folding-roller pair 34 forms a folding line on the looped sheet.

The processes performed in Steps ST04 to ST06 will be described below in greater detail. FIGS. 7A to 7F illustrate the sheet-folding steps which the sheet folding apparatus C performs in sequence after it receives the sheet from the image forming apparatus A.

[Registering Process]

Figure 7D:
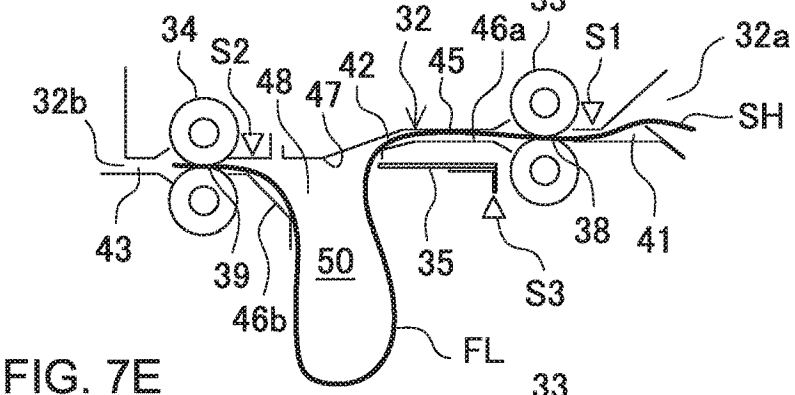
FIGS. 7A to 7F are sectional views illustrating the sheet-folding steps performed in the sheet folding apparatus.
Figure 7E:
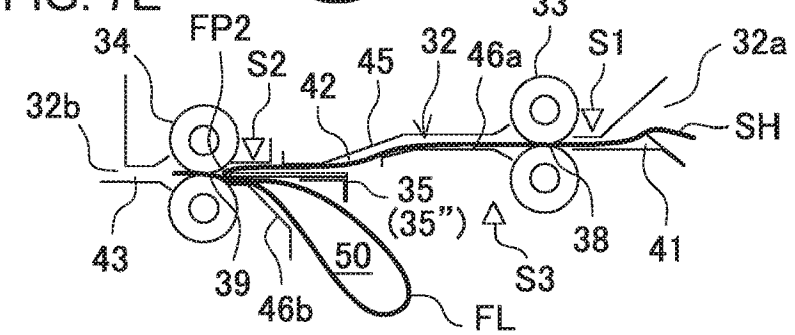
Figure 7F:
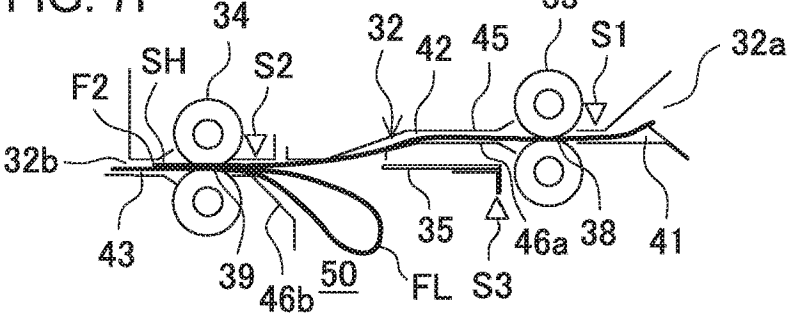
Figure 7A:
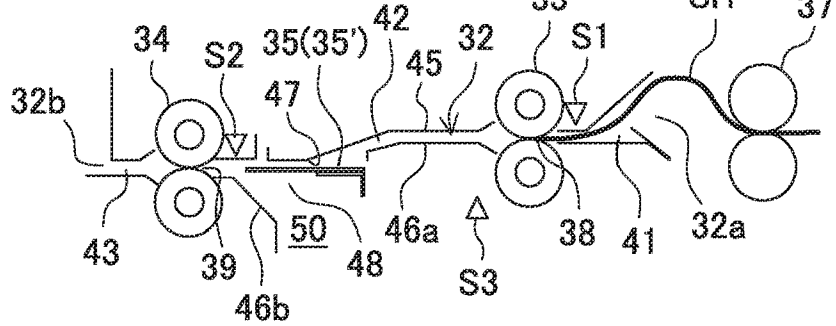
Figure 8:
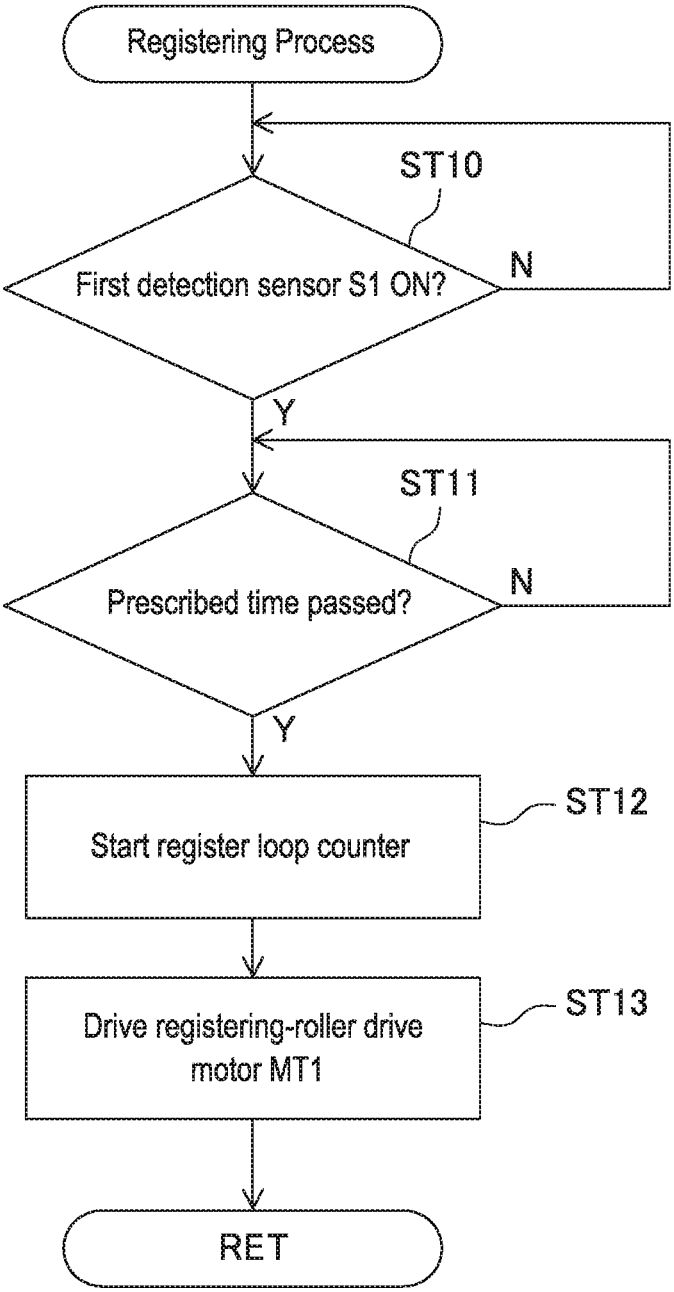
FIG. 8 is a flowchart explaining the registering step performed in the sheet folding apparatus.

FIG. 7A illustrates a sheet having its front edge aligned in the registering process performed in the sheet folding apparatus C. The control section 120 performs the registering process in accordance with, for example, the process sequence shown in the flowchart of FIG. 8.

The control section 120 waits until a prescribed time passes after the first detection sensor 51 detects the front edge of the sheet transported into the sheet inlet path 41 and is thereby turned on while the rotation of the registering-roller pair 33 is being halted (Y in Step ST10). The prescribed time is long enough to abut the sheet, at its front edge, on the nip part 38 of the registering-roller pair 33, thereby to align the front edge of the sheet. The prescribed time is preset in the control section 120 on the basis of, for example, the results of experiments.

When the prescribed time elapses (Y in Step ST11), the control section 120 actuates a register loop counter (i.e. software-operated timer counter), which starts measuring time (Step ST12). Then, the control section 120 drives the registering-roller drive motor MT1, rotating the registering-roller pair 33 (Step ST13).

As the registering-roller pair 33 is driven, the sheet is transported to the folding-roller pair 34 through the transport path 32 as is illustrated in FIG. 7A. At this time, the pushing plate 35 exists at the guiding position 35'. The sheet is therefore guided in the center path 42 to the upper surface of the pushing plate 35 and is transported straight to the nip part 39 of the folding-roller pair 34. After its front edge passes the protrusion 47 provided at the center path 42, the sheet is pushed by the protrusion 47 downward, forming a loop in the loop-forming space 50, namely in the region which opposes the large space 48 and in which the inclining part 45*c* and the second horizontal part 45*b* of the upper transport guide 45 are connected in the sheet-transporting direction. In the region opposing the space 48, the protrusion 47 pushes down the sheet, bending the sheet, in U shape, into the loop-forming space 50.

[Loop Forming Process]

Figure 7B:
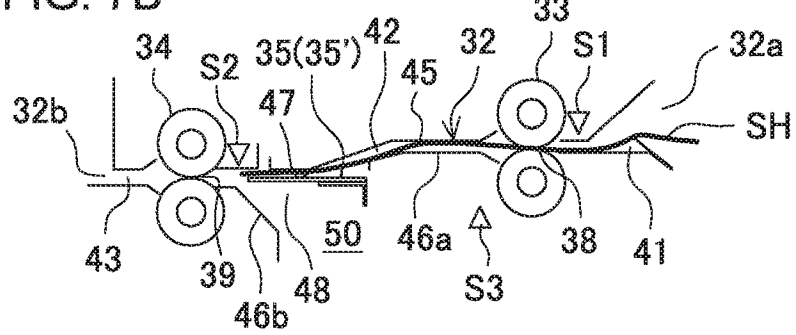
Figure 7C:
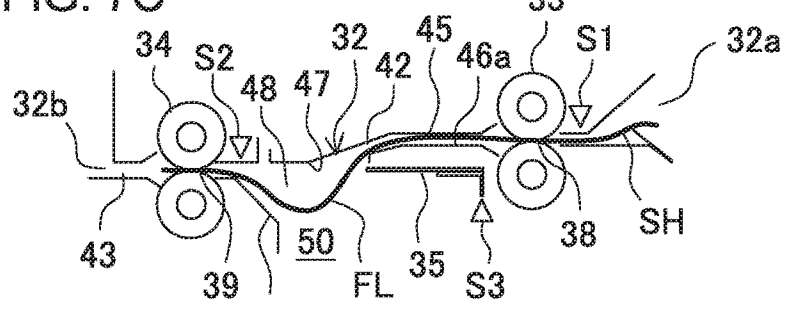
Figure 9:
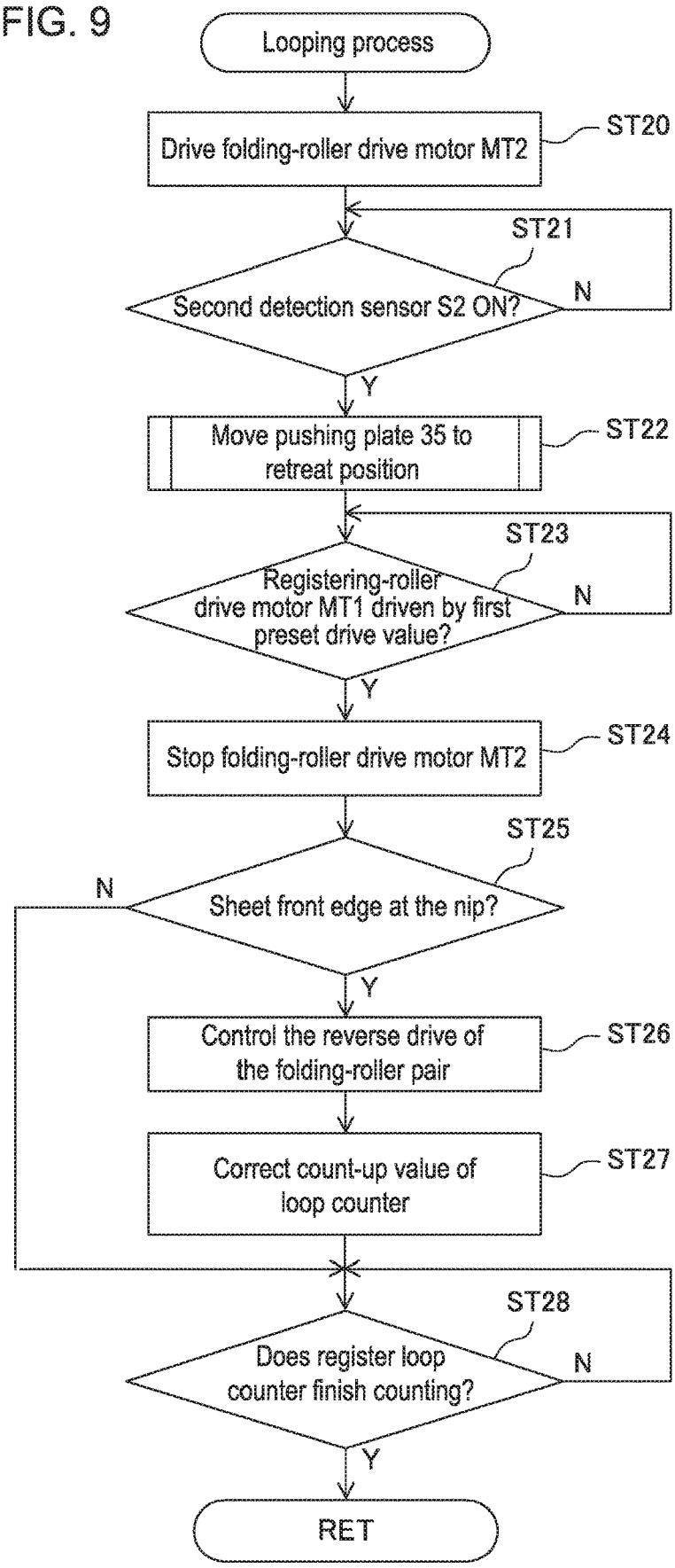
FIG. 9 is a flowchart explaining the loop forming step performed in the sheet folding apparatus.

The loop forming process is performed in, for example, the sequence illustrated in the flowchart of FIG. 9. When the registering-roller drive motor MT1 is driven, rotating the registering-roller pair in Step ST13, the control section 120 drives the folding-roller drive motor MT2, rotating the folding-roller pair 34 (Step ST20). As shown in FIG. 7B, the second detection sensor S2 detects the front edge of the sheet being transported, at a position immediately upstream the folding-roller pair 34, and is thereby turned on (Y in Step ST21). Then, the control section 120 performs a process of moving the pushing plate 35 from the guiding position 35' to the retreat position (Step ST22).

Figure 10:
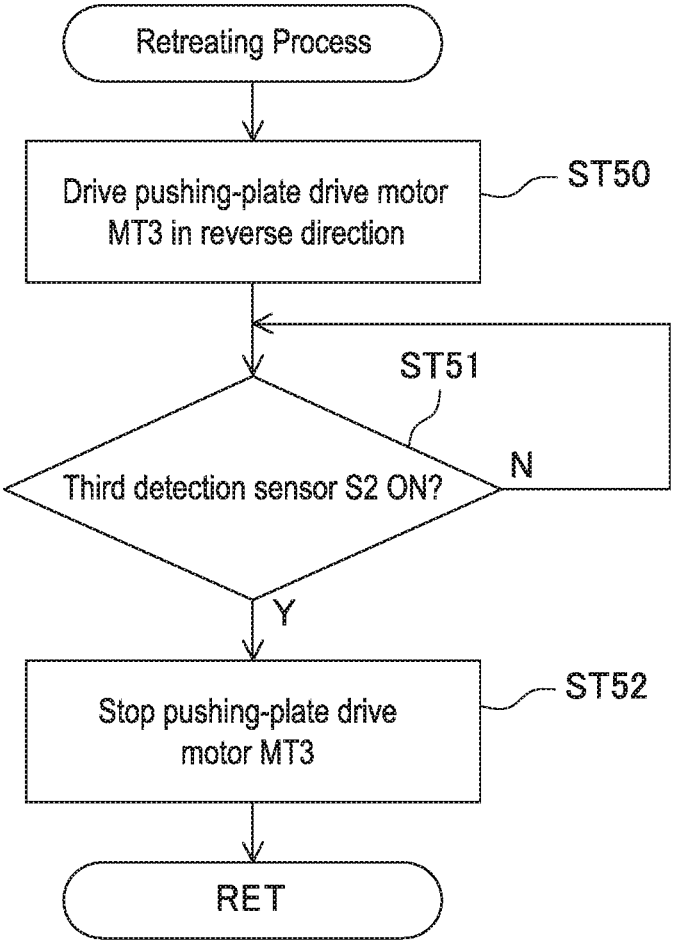
FIG. 10 is a flowchart explaining how a pushing plate moves to the retreat position.

The process of retreating the pushing plate 35 is performed in, for example, the sequence shown in the flowchart of FIG. 10. The control section 120 drives the pushing-plate drive motor M3 in the reverse direction (Step ST50), moving the pushing plate 35 upstream in the sheet-transporting direction from the guiding position 35' toward the retreat position. In this embodiment, the pushing plate 35 has a detection flag (not shown) at its end upstream as viewed in the sheet transporting direction.

When the third detection sensor S3 arranged below the first lower guide part 46*a* detects the detection flag of the pushing plate 35 and is turned on (Y in Step ST51), the pushing-plate drive motor M3 is stopped (Step ST52). The pushing plate 35 is thereby moved to the retreat position shown in FIG. 7C, and the space 48 between the first and second lower guide parts 46*a* and 46*b* is fully opened. As a result, the second passage part of the center path 42 is opened to the loop-forming space 50 located below.

Next, the control section 120 starts driving the registering-roller drive motor MT1 when the second detection sensor S2 detects the front edge of the sheet in Step ST21, and keeps driving the registering-roller drive motor MT1 until the motor MT1 is driven by a first preset drive value (Y in Step ST23). Then, the control section 120 stops the folding-roller drive motor MT2 (Step ST24). The first preset drive value is equivalent to the value by which the registering-roller drive motor MT1 should be driven to move the sheet to the position where the front edge of the sheet is nipped at the nip part 39 of the folding-roller pair 34. The drive amount of the registering-roller drive motor MT1 can be the rotation value of the motor (i.e., the number of rotations, rotation angle or rotation time of the rotor shaft) or the distance the sheet is transported by the registering-roller pair 33, namely the rotation value of the driving roller 33*a* (i.e., the number of rotations, rotation angle or rotation time of the roller shaft 61).

The sheet is therefore held, with its front edge nipped at the nip part 39 of the folding-roller pair 34. Thereafter, the registering-roller drive motor MT1 is kept driven. The registering-roller pair 33 therefore keeps rotating, transporting the sheet further. As a result, that part of the sheet, which is upstream of the folding-roller pair 34, hangs down into the loop-forming space 50 through the space 48, forming a loop FL. The loop FL will be processed to make a folding line.

Thereafter, the loop FL grows as the registering-roller pair 33 transports the sheet. The sheet nipped, at its front edge, by the registering-roller pair 33, bulges into the loop-forming space 50, as described above, before the pushing plate 35 is retreated. Hence, the sheet is smoothly and stably bent, forming a loop in the loop-forming space 50, without excessively increasing the load on the registering-roller drive motor MT1.

In this embodiment, the distance (i.e., transport distance) the sheet is transported until the front edge of the sheet moves from the position where it is detected by the second detection sensor S2 to the position 10 mm ahead the nip part 39 of the folding-roller pair 34 is converted into the drive value of the registering-roller drive motor MT1, which corresponds to the distance, and this value is used as the first preset drive value mentioned above.

In the sheet folding apparatus C, the part of the foldable sheet, at which the sheet will be folded and which is identified from, for example, the distance from the front edge of the sheet in the sheet transporting direction is predetermined from the size and orientation (lengthwise or widthwise) of the sheet. The prescribed count value equivalent to said part of the sheet is preset in the register loop counter. After the folding-roller drive motor MT2 is stopped in Step ST24, the count value of the register loop counter that starts operating in Step ST11 is increased to the prescribed count value (Y in Step ST25). Then, the operation goes to the next folding-line forming process (i.e., Step ST06).

[Folding-Line Forming Process]

Figure 11:
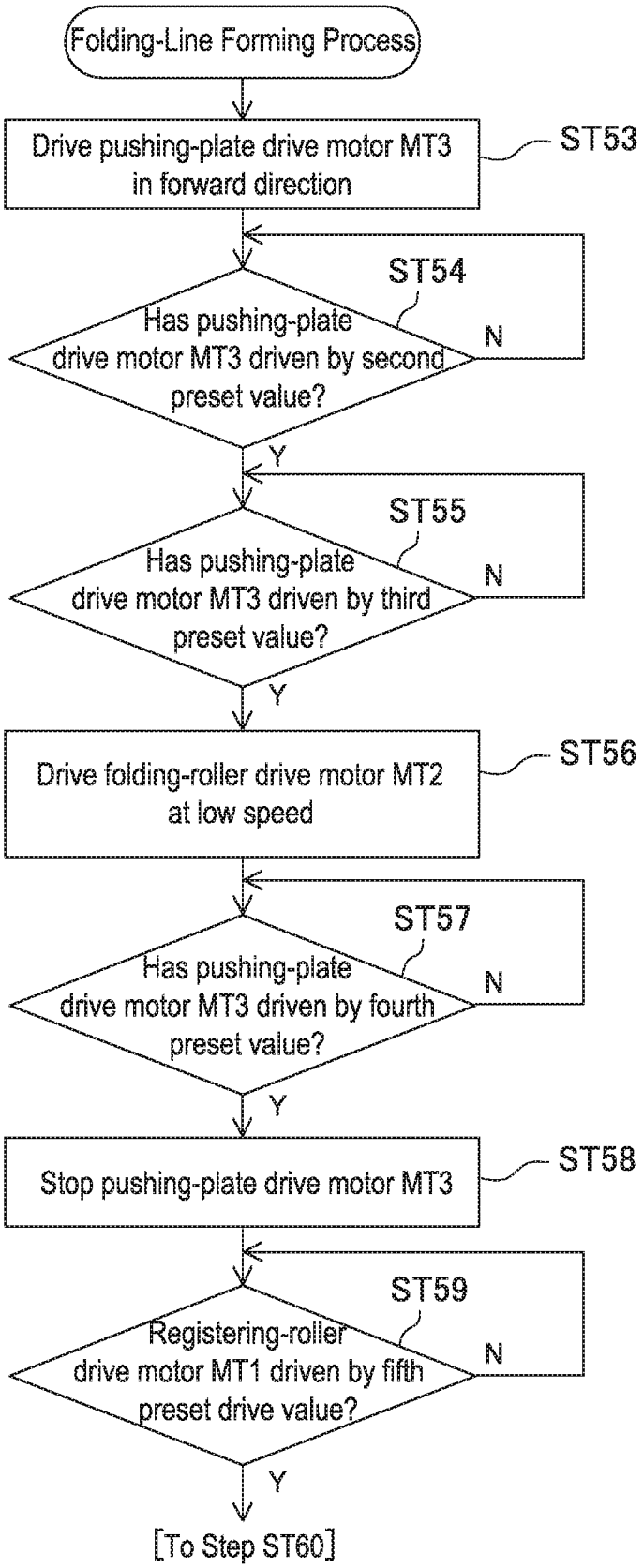
FIG. 11 is a flowchart explaining how the sheet folding apparatus folds a sheet.
Figure 12:
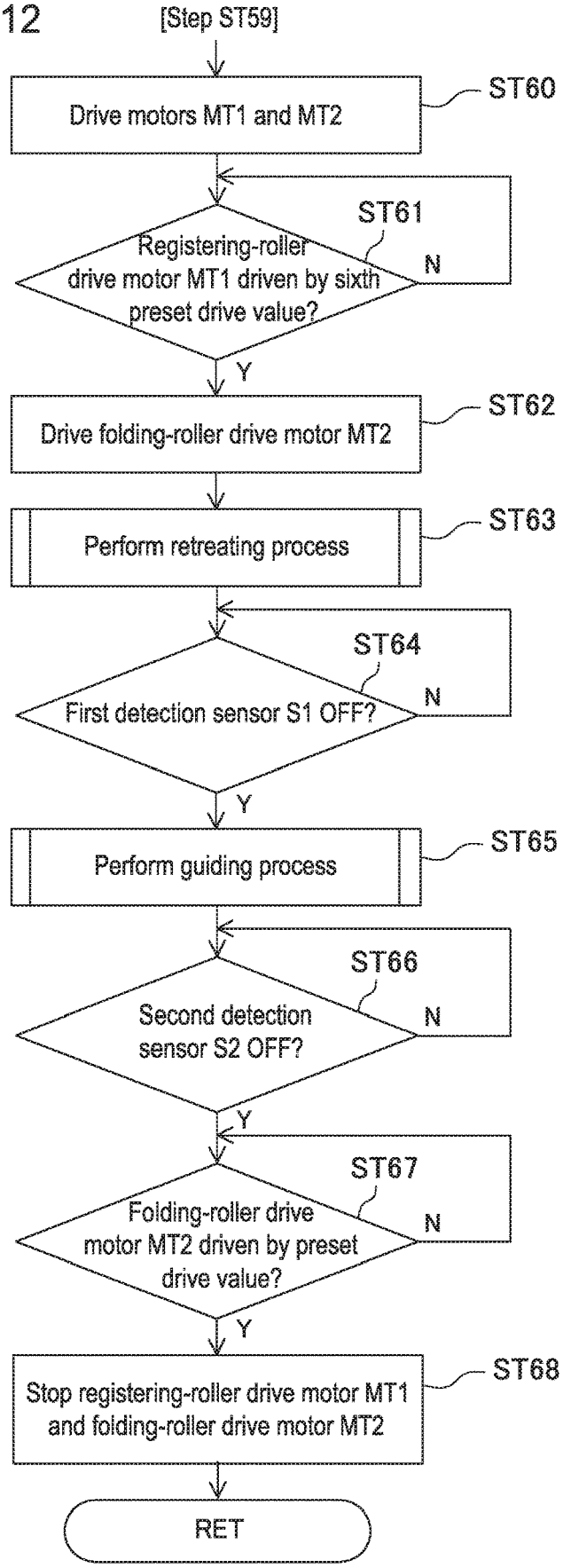
FIG. 12 is a flowchart explaining how the sheet folding apparatus folds a sheet, in the steps following the last step shown in FIG. 11.

After the sheet is warped to a prescribed degree in the loop-forming space 50, the control section 120 performs the folding-line forming process. The folding-line forming process is performed, for example, in the sequence shown in the flowchart of FIGS. 11 and 12. The control section 120 starts the process of moving the pushing plate 35 when the register loop counter finishes counting in Step ST28. The registering-roller pair 33 keeps transporting the sheet, forming a loop FL in the loop-forming space 50 as shown in FIG. 7(*d*). The loop FL has a size desirable to make a folding line at the prescribed part of the sheet.

First, the control section 120 drives the pushing-plate drive motor M3 (Step ST53), moving the pushing plate 35 in horizontal direction toward the folding-roller pair 34. The pushing plate 35 moves toward the nip part 39 of the folding-roller pair 34, while its front edge is pushing that part of the loop FL which will form a folding line which is the second line as seen from the front edge of the sheet. While the pushing plate 35 is moving, the control section 120 controls the registering-roller drive motor MT1 and the pushing-plate drive motor M3, moving the pushing plate 35 at the same speed as the sheet is transported by the registering-roller pair 33 so that the loop FL pushed by the front end of the pushing plate 35 may not change in position and the pushing plate 35 may move at the same speed v1 as the sheet is transported by the registering-roller pair 33. Driven by the pushing-plate drive motor M3, the pushing plate 35 moves to the pushing position 35" to a position immediately before the nip part 39.

Figure 13:
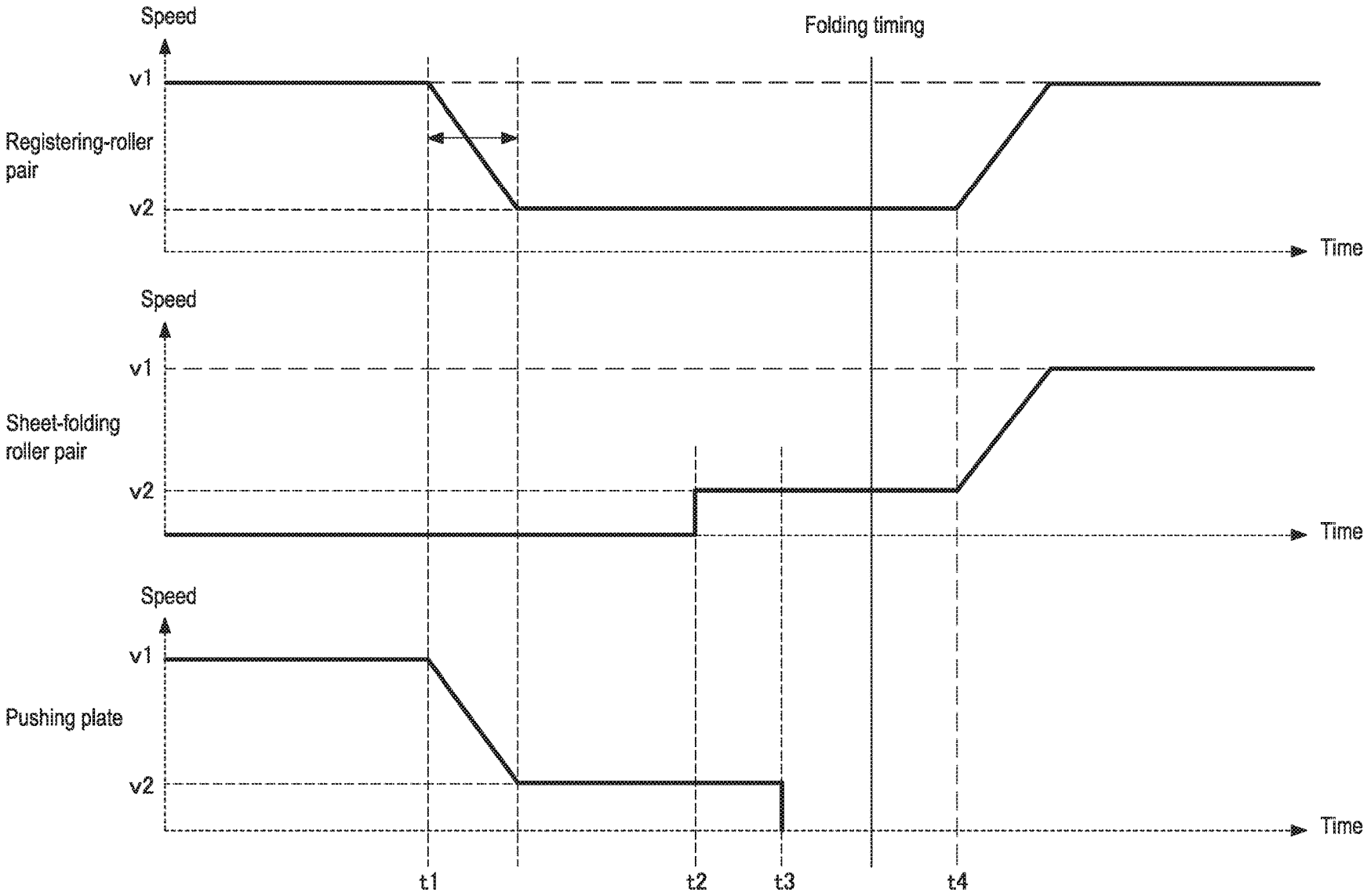
FIG. 13 is a timing chart explaining how a pair of registering rollers, a pair of folding rollers operate and a pushing plate operate.
Figure 15A:
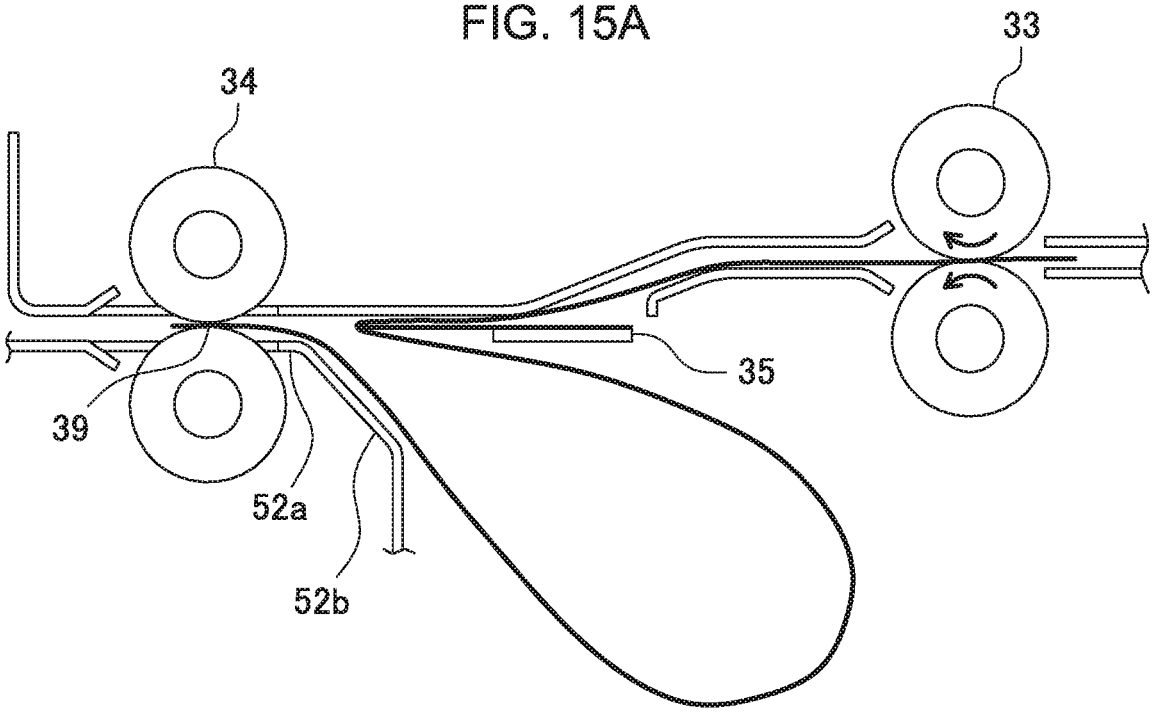
FIGS. 15A and 15B show two positions the pushing plate takes at time t1 and time t3 specified in the timing chart of FIG. 13.

This embodiment is characterized in that the control section 120 changes the speed at which the pushing plate 35 moves by the time when it reaches the pushing position 35", namely from a high speed to a low speed. That is, as shown in FIG. 13, the control section 120 sets the speed of moving the pushing plate 35 at value v1 at first. When the front edge of the pushing plate 35 reaches a preset position before the pushing position 35" at time t1, the control section 120 controls the pushing-plate drive motor M3, reducing the speed of the pushing plate 35 to a lower speed v2. As shown in FIG. 15A, the preset position before the pushing position 35" is a position immediately before the second horizontal guide part 52*a* which cooperates with the second horizontal part 45*b* of the upper transport guide 45 to guide the sheet toward the nip part 39. In this embodiment, however, the preset position is the guiding position 35'. At this time, the control section 120 equalizes the speed of the pushing plate 35 to the speed at which the registering-roller pair 33 transports the sheet. Hence, as the speed of moving the pushing plate 35 is decreased, the speed at which the registering-roller pair 33 transports the sheet is also reduced from v1 to v2.

More specifically, the control section 120 determines whether the pushing-plate drive motor M3 has been driven by a second preset value, thereby finding whether the pushing plate 35 has moved to the guiding position 35' (Step ST54). The second preset value is the drive value that enables the pushing-plate drive motor M3 to move the pushing plate 35 at the speed v1 to a position immediately before the second horizontal guide part 52*a*. The second preset value can be the rotation value of the motor MT2 (i.e., number of revolutions, angle of rotation or rotation time) or the distance the pushing plate 35 should be moved.

This embodiment is further characterized in that the control section 120 controls the folding-roller drive motor MT2 in order to start driving the folding-roller pair 34 at low speed at the time immediately before the pushing plate 35 reaches the pushing position 35".

Figure 15B:
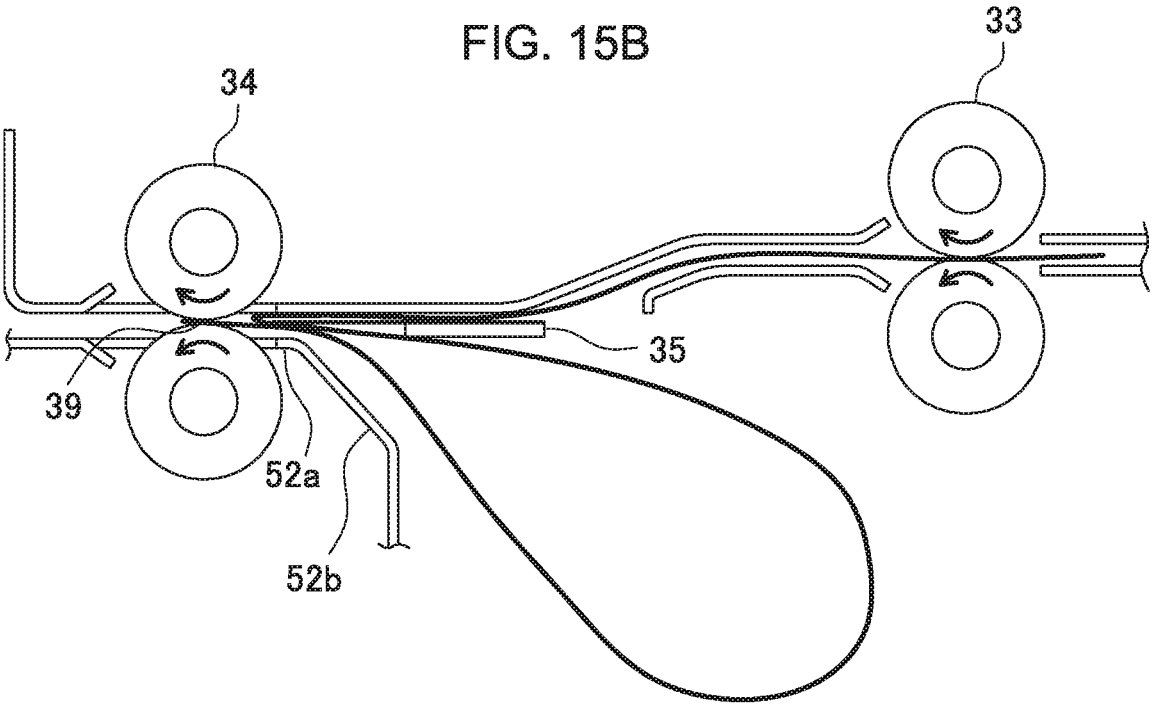

More specifically, the folding-roller drive motor MT2 is driven (Step ST56) at time t2 when the drive value of the pushing-plate drive motor M3 reaches a third preset value (Y in Step ST 55) after the moving speed of the pushing plate 35 is switched to the speed v2, so that the folding-roller pair 34 may rotate at the same speed as the sheet-transporting speed v2 of the registering-roller pair 33 as shown in FIG. 15B.

Next, when the driven value of the pushing-plate drive motor M3 reaches a fourth preset value at time t3 (Y in Step ST57), the control section 120 stops the pushing-plate drive motor M3, assuming that the pushing plate 35 has moved to the pushing position 35" (Step ST58).

When the pushing plate 35 moves to the pushing position 35", its front edge reaches, as is shown in FIG. 7A and FIG. 15B, a position between the second horizontal part 45*b* of the upper transport guide 45 and that of the second horizontal guide part 52*a* of the second lower guide part 46*b*. Therefore, that part FP 2 of the sheet, at which the sheet will be folded to form the second folding line 203 (in FIG. 4), is bent as described above and is transported to a position immediately before the nip part 39 of the folding-roller pair 34.

Thus, the pushing plate 35 and the folding-roller pair 34 are simultaneously driven between time t1 when the pushing plate 35 transports the folding part of the sheet, at which second folding line 203 will be made, to a prescribed position before the pushing position 35" (i.e., guiding position 35' in this embodiment), and time t2 when the pushing plate 35 transports the folding part to the pushing position 35". Therefore, the sheet is not pushed by the pushing plate 35, and is transferred to the folding-roller pair 34. Since the sheet is not pushed into the space P illustrated in FIG. 17, the tab T protruding from the nip part 39 can therefore have a prescribed size, regardless of the thickness of the sheet. In addition, the sheet can be reliably transferred from the pushing plate 35 to the folding-roller pair 34, because the pushing plate is moved at the same speed as the speed v2 at which the folding-roller pair 34 transports the sheet.

Even after the pushing-plate drive motor M3 is stopped in Step ST58, the control section 120 keeps driving the registering-roller pair 33 and the folding-roller pair 34 at the speed v2. Therefore, as shown in FIG. 7F, that part of the sheet, which will be folded to form the second folding line, is taken into the nip part 39 of the folding-roller pair 34. As the sheet is transported downstream, said part the sheet is pressed and folded between the upper folding roller 34*a* and the lower folding roller 34*b*. The sheet therefore has a second folding line 203 at a prescribed position.

The driven value of the registering-roller drive motor MT1 reaches a fifth preset value at time t4 (Y in Step ST59) after the second folding line is made. At this time t4, the control section 120 controls the registering-roller drive motor MT1 and the folding-roller drive motor MT2 so that the registering-roller pair 33 and the folding-roller pair 34 may transport the sheet at high speed v1 (Step ST60).

After the pushing-plate drive motor M3 is stopped in Step ST58, the registering-roller drive motor MT1 is driven by a sixth preset value (Y in Step ST61). Then, the control section 120 drives the folding-roller drive motor MT2 (Step ST62). The sixth preset value is the drive value by which the registering-roller drive motor MT1 is driven to rotate the registering-roller pair 33, thereby to transport the sheet continuously even after the pushing-plate drive motor M3 is stopped in Step ST58, until the part FP 2 of the sheet is taken into the nip part 39 of the folding-roller pair 34.

When the folding-roller pair 34 is driven by the folding-roller drive motor MT2, that part of the sheet, at which the second folding line will be made, is taken into the nip part 39 of the folding-roller pair 34 as shown in FIG. 7F. While being transported downstream, the sheet is pressed and bent between the upper folding roller 34*a* and the lower folding roller 34*b*. As the sheet is so pressed and bent, the second folding line 203 is made at a preset part. As described above, the bent part FP 2 of the sheet is transported, without slipping or changing in position in the sheet transporting direction, and is taken into the nip part 39 of the folding-roller pair 34. The second folding line 203 is positioned at high precision, unlike in the conventional apparatuses.

After driving the folding-roller drive motor MT2 in Step ST62, the control section 120 performs a plate-retreating process, moving the pushing plate 35 from the pushing position 35" back to the above-mentioned retreat position, not to prevent the sheet from being taken into the nip part 39 of the folding-roller pair 34 (Step ST63). The plate-retreating process is performed in the same way as in loop-forming process explained with reference to FIG. 10 and FIGS. 7B and 7C.

That is, in the state of FIG. 7E, the control section 120 drives the pushing-plate drive motor M3 in reverse direction, moving the pushing plate 35, in the horizontal direction, from the pushing position 35" toward the above-mentioned retreat position. When the third detection sensor S3 arranged below the first lower guide part 46*a* detects the detection flag of the pushing plate 35, and is therefore turned on, the pushing-plate drive motor M3 is stopped. The pushing plate 35 is thereby arranged at the retreat position as shown in FIG. 7F.

At this time, the space 48 between the first lower guide part 46*a* and the second lower guide part 46*b* is fully opened and the second passage part of the center path 42 is connected to the loop-forming space 50 located below. The loop FL can therefore be continuously and smoothly taken into the nip part 39 of the folding-roller pair 34 from the nipping start as illustrated in FIG. 7E, not interfering with the pushing plate 35.

Even after the pushing plate 35 is moved to the retreat position, the folding-roller pair 34 is kept driven. Therefore, as shown in FIG. 7F, the sheet is nipped by the folding-roller pair 34, first at its front edge and then at two folding lines (namely, Z-folding lines) made by the folding-roller pair 34. The sheet is then transported downstream through the sheet outlet path 43.

As the sheet is so transported, the loop FL gradually becomes smaller in the loop-forming space 50. The loop FL then enters the third passage part of the center path 42, and is squeezed, from above and below, by the first horizontal part 45*a* of the upper transport guide 45 and the second inclining guide part 52*b* of the second lower guide part 46*b*. The loop therefore becomes a thin loop extending in the sheet transporting direction. The loop FL further moves into the gap between the second horizontal part 45*b* and the second horizontal guide part 52*a* of the second lower guide part 46*b*, and is folded double, from above and below, at a part FP1 at the rear edge (upstream edge) of the sheet, where a first folding line will be made.

The sheet having the folded part FP1, so bent as described above, is transported without slipping or changes in position, with respect to the upstream part of the sheet overlapped on it. The sheet is then pressed and bent at the nip part 39 of the folding-roller pair 34. The sheet can therefore have a first folding line (line 202 shown in FIG. 6) made at the desired position, with high reliability and high precision.

A Z-folded sheet SH is thereby obtained, which has an inner folding line 202 and an outer folding line 203 as illustrated in FIG. 4. In this embodiment, the folding-roller pair 34 not rotating forms a loop FL while they are nipping the front edge of the sheet, and the folding-roller pair 34 are then rotated, making the first and second folding lines. Hence, the front part of the sheet, nipped while forming a folding loop FL, is Z-folded while it is bulging from the second folding line toward the front edge (to downstream edge) of the sheet.

Next, the first detection sensor S1 detects the rear edge of the sheet being transported by the registering-roller pair 33 and the folding-roller pair 34, and is turned off (Y in Step ST64). Then, the control section 120 performs a guiding process, moving the pushing plate 35 from the retreat position to the guiding position 35' (Step ST65). At this time, the folding loop FL has already passed from the folding-roller pair 34. Therefore, even if the pushing plate 35 is moved to the guiding position 35', no troubles will be made in the process of transporting the sheet through the center path 42 or in the process of forming a folding line by using the folding-roller pair 34.

Figure 14:
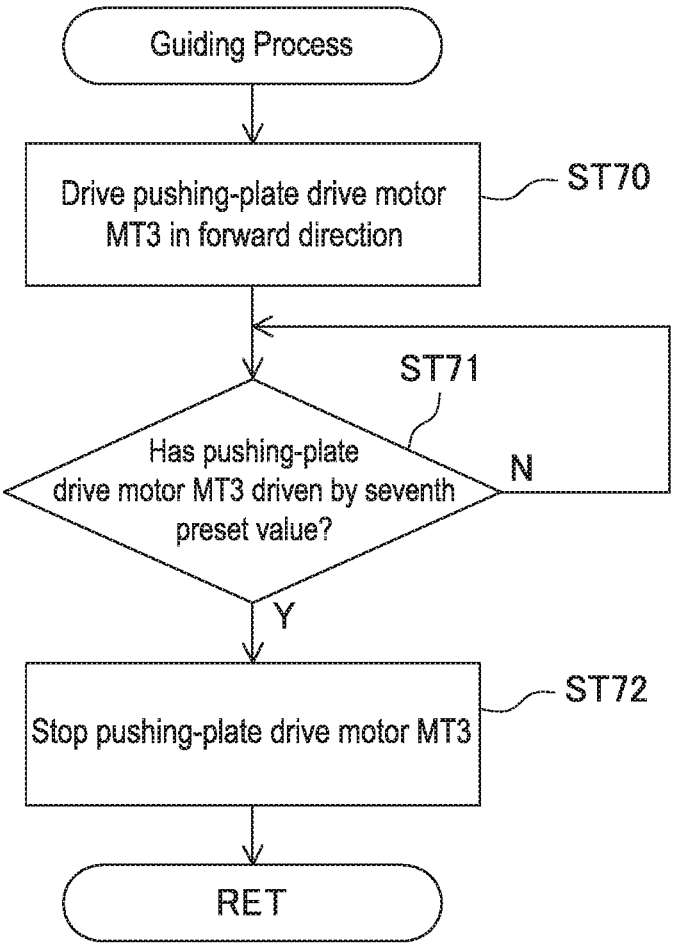
FIG. 14 is a flowchart explaining how the pushing plate is moved to a guiding position.

The above-mentioned guiding process is performed in the sequence shown in, for example, the flowchart of FIG. 14. First, the pushing-plate drive motor M3 is driven in the forward direction (Step ST70), moving the pushing plate 35 in horizontal direction toward the folding-roller pair 34. If the pushing-plate drive motor M3 is driven by the seventh preset value (Y in Step S71), the pushing-plate drive motor M3 is stopped (Step ST72).

The seventh preset value is the drive value of the pushing-plate drive motor M3, which is required to move the pushing plate 35 from the retreat position to the guiding position 35'. The pushing plate 35 therefore closes the gap between the first and second lower guide parts 46*a* and 45*b*. Then, the rear edge of the sheet is guided through the center path 42 onto the upper surface of the pushing plate 35, and the sheet is transported straight toward the folding-roller pair 34. The rotation value of the pushing-plate drive motor M3 (i.e., number of revolutions, angle of rotation or rotation time) can be used as the drive value of the pushing-plate drive motor M3.

Next, the second detection sensor S2 may detect the rear edge (i.e., upstream edge) of the sheet passing through the center path 42, and may be turned off (Y in Step ST66). At this time, the control section 120 starts measuring the drive value of the folding-roller drive motor MT2. When the drive value of the motor MT2 reaches a preset motor-stopping value (Y in Step ST67), the registering-roller drive motor MT1 and the folding-roller drive motor MT2 are stopped (Step ST68).

The motor-stopping value mentioned above is a drive value of the folding-roller drive motor MT2, which is large enough to allow the rear edge of the sheet to pass through the nip of the folding-roller pair 34. The registering-roller pair 33 and the folding-roller pair 34 can therefore be stopped without making any trouble in transporting the sheet through the sheet-outlet port 32*b* to the sheet post-processing apparatus B, terminating the process of Z-folding the sheet.

[Modification 1]

Figure 16:
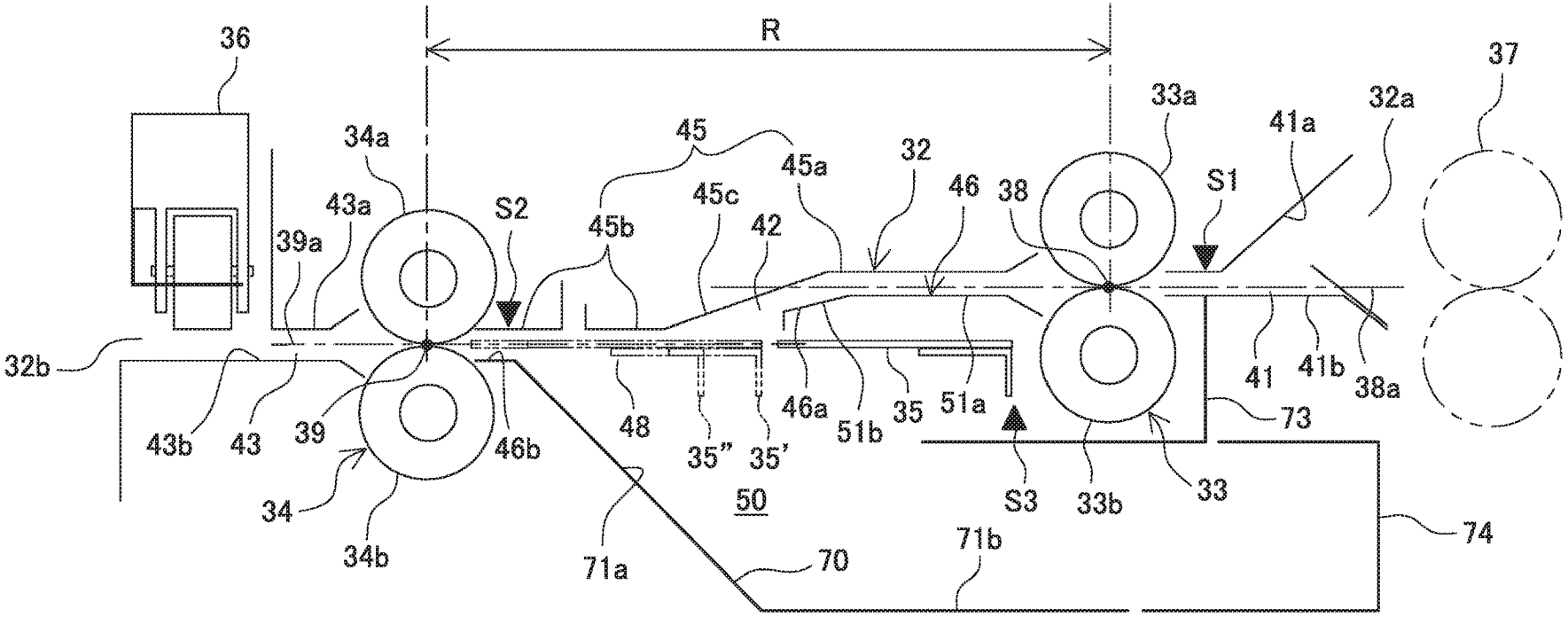
FIG. 16 is a schematic diagram of the sheet folding apparatus according to a modification 1.

The first modification of the embodiment described above will be described below. In the first modification, a loop guide unit 70 different from the loop guide unit 53 is provided. FIG. 16 is a schematic diagram of a sheet folding apparatus having the loop guide unit 70. FIGS. 17A, 17B and 17C and FIGS. 18A, 18B and 18C show how a sheet has a loop part in the sheet folding apparatus having the loop guide unit 70. While the loop guide unit 53 described above restricts only the upstream part of the sheet loop, the loop guide unit 70 in the modification 1 restricts both the upstream and downstream parts of the sheet loop.

As shown in FIG. 16, the loop guide unit 70 has a first loop guide 71*a* and a second loop guide 71*b*. The first loop guide 71*a* is connected to that end of the second lower guide part 46*b*, which is upstream in the sheet transporting direction. The second loop guide 71*b* extends upstream from the upstream end of the first loop guide 71*a* in the sheet transporting direction. The modification 1 is identical, in configuration, to the embodiment described above, except for the use of the loop guide unit 70.

The first loop guide 71*a* of the loop guide unit 70 inclines upward from the upstream end of the second lower guide part 46*b*, gradually leaving the second horizontal part 45*b* of the upper transport guide 45 in the vertical direction. The second loop guide 71*b* of the loop guide unit 70 extends upstream almost horizontally from the lower end of the first loop guide 71*a*. In this embodiment, the lower end of the first loop guide 71*a* extends in the sheet transporting direction to a position near the downstream end of the first lower guide part 46*a* in the sheet transporting direction, and the upstream end of the second loop guide 71*b* extends to a position below the registering-roller pair 33. Since the loop guide unit 70 is so configured, the loop-forming space 50 is relatively shallow in the height direction intersecting at right angles with the sheet transporting direction, and is relatively long in the sheet transporting direction, below the center path 42.

Figure 17A:
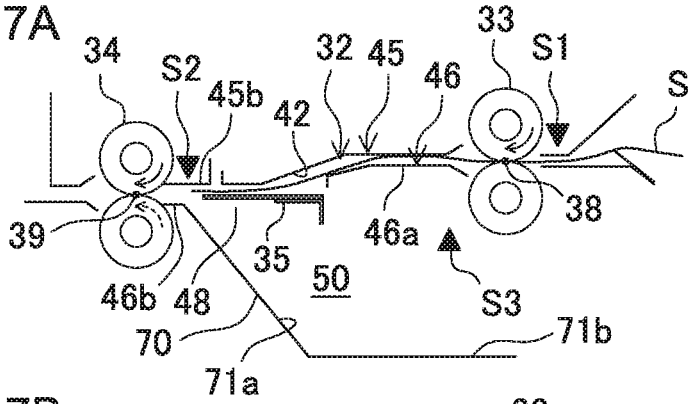
FIGS. 17A, 17B and 17C are diagrams showing how the loop of the sheet is restricted in the loop guiding section provided in the sheet folding apparatus according to the modification 1.
Figure 17B:
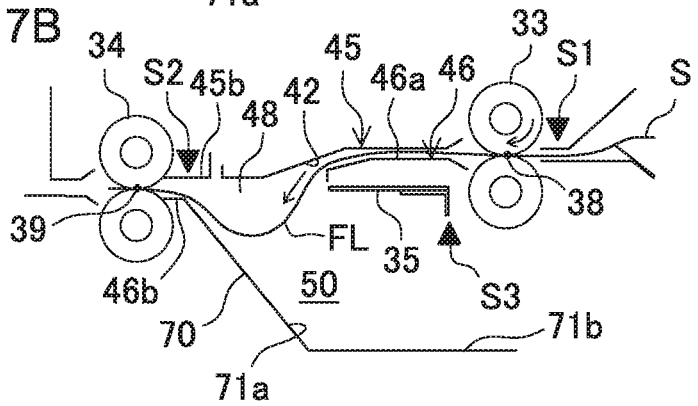
Figure 17C:
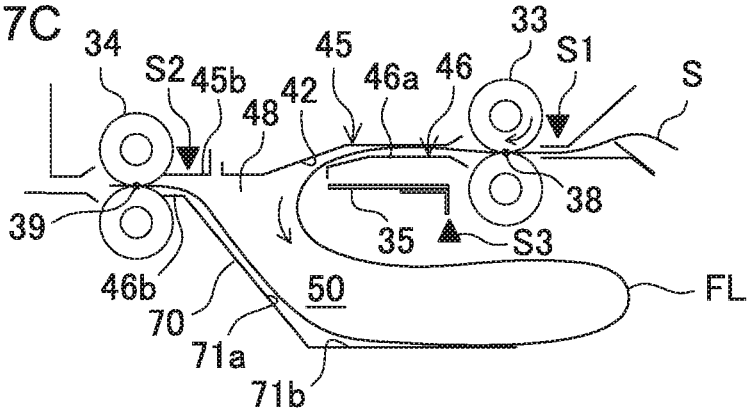

FIGS. 17A, 17B and 17C are diagrams showing how the loop of the sheet is restricted in the loop guide unit 70. As shown in FIG. 17A, the sheet is transported to the folding-roller pair 34 along the transport path 32 as the registering-roller pair 33 and folding-roller pair 34 are driven. The sheet is then nipped by the folding-roller pair 34.

Thereafter, the folding-roller pair 34 are stopped, and the pushing plate 35 is moved to the retreat position. The front edge of the sheet is thereby nipped by the folding-roller pair 34. When the registering-roller pair 33 transports the sheet, while the folding-roller pair 34 is stopped, the sheet in the center path 42 is bent into the loop-forming space 50, in the form of a loop, through the space 48, as is illustrated in FIG. 17B.

The more the sheet hangs, forming a loop, in the loop-forming space 50, the more it bends along the slope from the folding-roller pair 34 to the first loop guide 71*a* of the loop guide unit 70. Then, as shown in FIG. 17C, a loop is made, extending upstream in the sheet transporting direction. The loop is relatively thin in the height direction and extends comparatively long in the sheet transporting direction within the loop-forming space 50 the lower side of which is regulated by the loop guide unit 70. The loop, long in the sheet transporting direction, can be smoothly drawn along the loop guide unit 70 into the nip of the rotating folding-roller pair 34.

Immediately below the registering-roller pair 33 and the pushing plate 35 in the retreat position, a first partitioning member 73 is provided and secured to the housing 31. The first partitioning member 73 partially defines the upper part of the loop-forming space 50, and positions the sheet or the sheet loop, in the loop-forming space 50, from the registering-roller pair 33 and the pushing plate 35. In FIG. 16, the downstream end of the first partitioning member 73 lies near the middle part of the pushing plate 35 in the retreat position, as viewed in the sheet transporting direction. However, the first partitioning member 73 may extend to a position near the downstream end of the pushing plate 35. Conversely, the first partitioning member 73 can be shorter to partition only the registering-roller pair 33.

Moreover, a second partitioning member 74 is secured to the housing 31 and extends to the upstream side from the loop guide unit 70 and first partitioning member 73. The second partitioning member 74 defines the loop-forming space 50 in the sheet transporting direction, and prevents the sheet or the loop from extending from the loop-forming space 50, upstream in the sheet transporting direction.

The first partitioning member 73 can not only position the sheet and the loop in the loop-forming space 50, away from the registering-roller pair 33 and the pushing plate 35, but can also restrict the sheet loop in the sheet transporting direction, from above in the height direction. In this case, the first partitioning member 73 can be said to constitute a part of the loop guide unit 70. The first partitioning member 73 and the loop guide unit 70 can be secured to the housing 31 separately, or can be formed integral to each other.

Like the first partitioning member 73, the second partitioning member 74 can be arranged to restrict the sheet loop in the sheet transporting direction, from above in the height direction, in the loop-forming space 50. If this is the case, the second partitioning member 74 and the loop guide unit 70 can be secured to the housing 31 separately, or can be formed integral to each other.

In the embodiment described above, the registering-roller pair 33 transports the sheet downstream, while the folding-roller pair 34 is nipping the sheet and stopping the sheet, and a sheet loop is thereby formed. Alternatively, the folding-roller pair 34 may transport the sheet upstream in the reverse direction (namely, toward the registering-roller pair 33, while the registering-roller pair 33 is nipping the sheet and stopped, thereby to make a sheet loop.

Figure 18A:
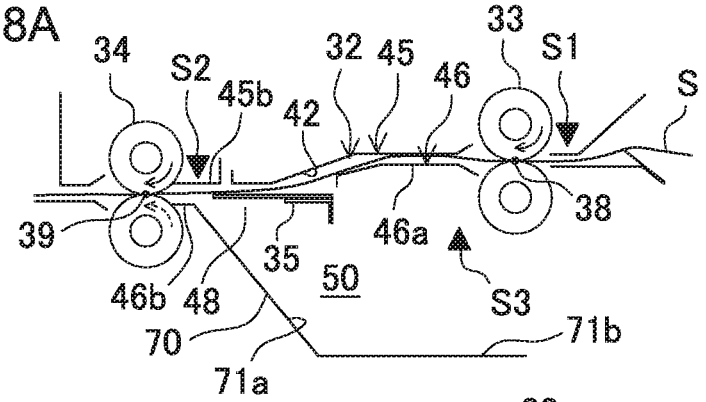
FIGS. 18A, 18B and 18C are diagrams showing how a sheet has a loop part as the folding rollers rotate in the reverse direction in the sheet folding apparatus according to the modification 1.
Figure 18B:
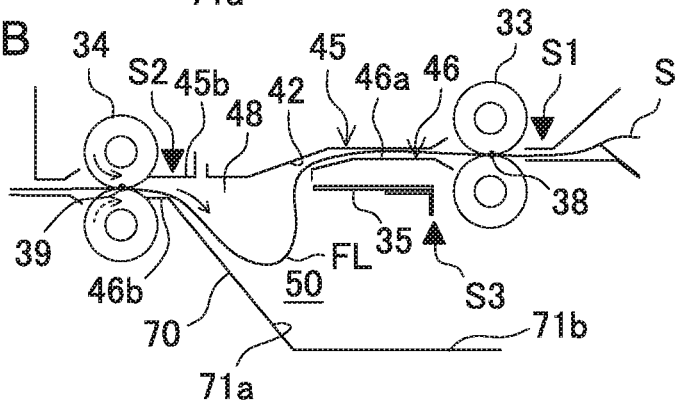
Figure 18C:
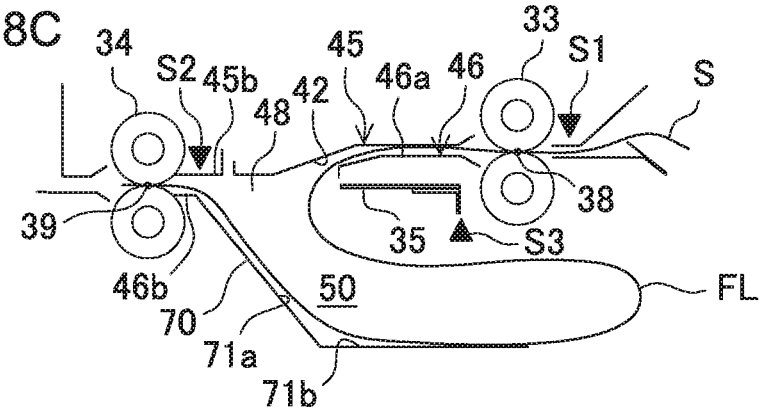

FIGS. 18A, 18B and 18C are diagrams showing how a sheet makes a loop part as the folding rollers rotate in the reverse direction in the sheet folding apparatus according to the modification 1. As shown in FIG. 18A, the registering-roller pair 33 and the folding-roller pair 34 are driven, and transport the sheet to the downstream side. When the sheet passes through the folding-roller pair 34 for the distance equivalent to that part which will be bent to form a loop, the registering-roller pair 33 and the folding-roller pair 34 are stopped rotating. Immediately thereafter, the folding-roller pair 34 is rotated in the reverse direction as shown in FIG. 18B, moving the front edge of the sheet S therefore in the upstream direction, while the registering-roller pair 33 is nipping the sheet S. As a result, that part of the sheet, which is upstream the folding-roller pair 34, is bent, making a loop which hangs down in the loop-forming space 50. As shown in FIG. 18C, the loop extends upstream in the sheet transporting direction. When the sheet is transported reversely for the distance equivalent to the length of the loop, the folding-roller pair is stopped.

That is, the folding loop FL further extends smoothly from the first loop guide 71*a* along the second loop guide 71*b* to the upstream side in the sheet transporting direction in accordance with the transport distance of the sheet reversely transported by the folding-roller pair. The loop FL is therefore elongated in the loop-forming space 50 regulated by the loop guide 70, is relatively thin in the height direction and is relatively long in the sheet transporting direction.

[Modification 2]

Figure 19A:
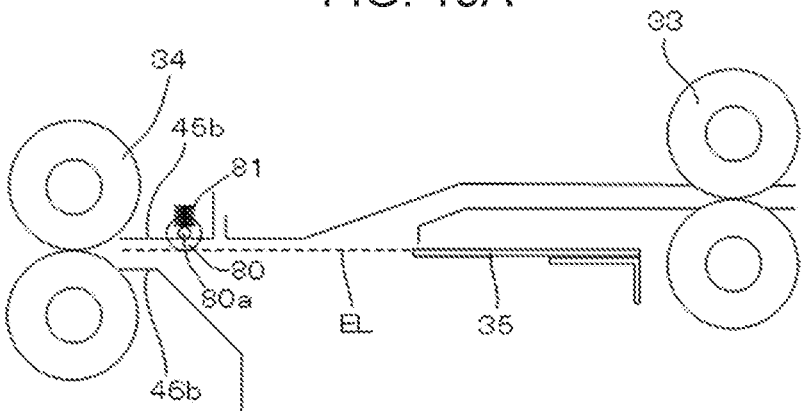
FIG. 19A is a configuration diagram showing the major parts of a sheet folding apparatus according to modification 2.
Figure 19B:
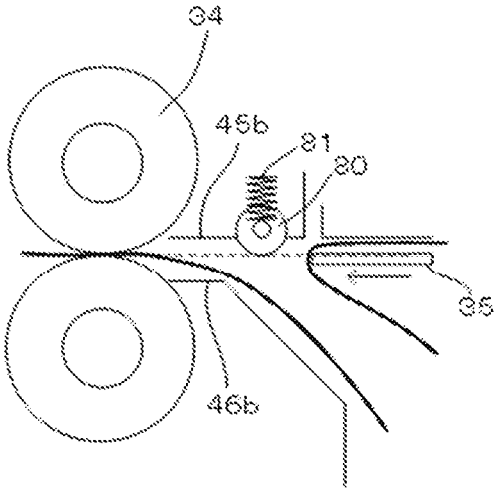
FIGS. 19B and 19C are diagrams showing how the driven roller functions in the sheet folding apparatus according to modification 2.
Figure 19C:
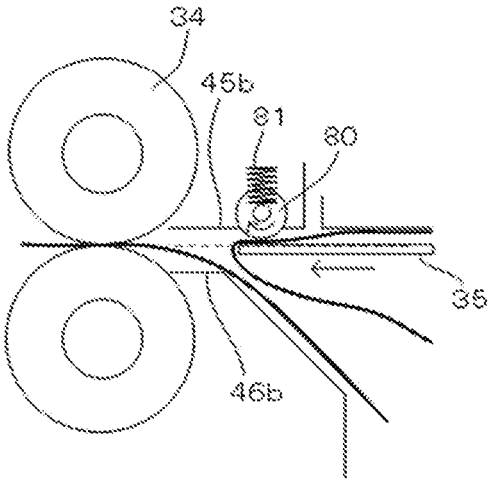

The second modification of the embodiment described above will be described below. In the second modification, a driven roller 80 is provided at the second horizontal part 45*b* of the upper transport guide 45. FIG. 19A is a diagram showing the major parts of a sheet folding apparatus provided with a driven roller 80. FIGS. 19B and 19C are diagrams explaining the function of the driven roller 80.

The driven roller 80 is secured to the second horizontal part 45*b* of the upper transport guide 45, and has a shaft 80*a* that can freely rotate. The driven roller 80 is biased downwards by a spring 81. As shown in FIG. 19A, the outer circumferential surface of the driven roller 80 lies on the extension line EL extending in the moving direction of the pushing plate 35 shown in FIG. 19A, or a little below the extension line EL. The driven roller 80 is arranged in or above the port into which the pushing plate 35 protrudes in the gap between the second horizontal part 45*b* of the upper transport guide 45 and the second lower guide part 46*b* of the lower transport guide 46.

The function of the driven roller 80 will be explained. The pushing plate 35 pushes the sheet at the part where the second folding line (line 203 shown in FIG. 4) will be formed. The sheet is therefore moved toward the nip part 39 of the folding-roller pair 34, as shown in FIG. 19B. When the pushing plate 35 reaches the driven roller 80, it abuts on the sheet placed on the outer circumferential surface of the driven roller 80. The driven roller 80 is therefore pushed up against the bias of the spring 81 and presses the sheet onto the upper surface of the pushing plate 35. Then, the pushing plate 35 enters the gap between the second horizontal part 45*b* of the upper transport guide 45 and the second lower guide part 46*b* of the lower transport guide 46. The pushing plate 35 then moves to the pushing position 35". At this time, the driven roller 80 rotates as the sheet moves, while pushing the sheet onto the upper surface of the pushing plate 35, as illustrated in FIG. 19C. This can reduce the load applied to the sheet entering the gap between the gap between the second horizontal part 45*b* of the upper transport guide 45 and the second lower guide part 46*b* of the lower transport guide 46, and also the load applied on the sheet already entered the gap. Moreover, this can suppress the slipping or dislocation of that part of the sheet, at which the sheet will be folded.

It is desirable that two driven rollers 80 should be provided, respectively at the sides of the sheet, spaced apart in the widthwise direction of the sheet. In the modification 2, two driven rollers 80 are arranged respectively at the sides of the sheet of minimum size that can be processed.

The preferred embodiments of this invention has been described above. However, the invention is not limited to the embodiments. Needless to say, the invention can be reduced to practice, by changing or modification, within its technical scope.

This application is based upon and claims the benefit of priority from Japanese Patent Application No. 2018-230527, filed Dec. 10, 2018, Japanese Patent Application No. 2018-245126, filed Dec. 27, 2018 and Japanese Patent Application No. 2019-094929, filed May 21, 2019, the entire contents of which are incorporated herein by reference.

What is claimed is:

1. A sheet-folding apparatus for folding sheets, comprising:

a transporting-roller pair configured to transport a sheet;

a folding-roller pair configured to nip a prescribed part of the sheet and fold the sheet;

a space provided between the transporting-roller pair and the folding-roller pair, for hanging the sheet being transported by the transporting-roller pair;

a pushing member configured to push a prescribed part of the sheet hanging in the space and to guide the prescribed part of the sheet to a nip part of the folding-roller pair; and first and second guide members configured to guide the sheet to the nip part of the folding-roller pair, while restricting, at both sides in the thickness direction, that part of the sheet which is bent by the pushing member.

2. The sheet-folding apparatus according to claim 1, wherein the front edge of the sheet hangs in the space, and the pushing member pushes a prescribed part of the sheet, thereby bending the sheet.

3. The sheet-folding apparatus according to claim 1, wherein a loop made of the sheet hangs to the pushing member and pushes a prescribed part of the sheet and bends the sheet.

4. The sheet-folding apparatus according to claim 1, which further comprises a transport path extending from the transporting-roller pair to the folding-roller pair, the first and second guide members constitute a downstream part of the transport path, an upstream part of the transport path is composed of third and fourth guide members opposing each other, and the first and second guide members are spaced apart more than the third and fourth guide members are spaced apart.

5. The sheet-folding apparatus according to claim 1, wherein the first and second guide members have parallel surfaces opposing each other, and the pushing member protrudes into a space between the parallel surfaces of the first and second guide members.

6. The sheet-folding apparatus according to claim 1, wherein which the second guide member is arranged above the first guide member, and which further comprises a driven roller configured to rotate in contact with the sheet guided by the pushing member to the second guide member.

7. The sheet-folding apparatus according to claim 1, further comprising a drive section for moving the pushing member to a pushing position between the first and second guide members to nip a prescribed part of the sheet at the folding-roller pair, to a guiding position to guide the front edge of the sheet transported by the transporting-roller pair to a nip between the first and second guide members, and to a retreat position upstream the guiding position in a sheet transporting direction, thereby to transport the sheet into the space.

8. The sheet-folding apparatus according to claim 1, further comprising a control section configured to start driving the folding-roller pair after the pushing member moves into a gap between the first and second guide members and before the prescribed part of the sheet reaches the position where the sheet is nipped by the folding-roller pair.

9. The sheet-folding apparatus according to claim 8, wherein the control section first drives the folding-roller pair at a first speed and then drives the folding-roller pair at a second speed higher than the first speed.

10. The sheet-folding apparatus according to claim 1, further comprising a driven roller configured to rotate in contact with the sheet guided by the pushing member between the first guide member and the second guide member.

11. A sheet-folding apparatus for folding sheets, comprising:

a transporting-roller pair configured to transport a sheet;

a folding-roller pair configured to nip a prescribed part of the sheet and fold the sheet;

a space provided between the transporting-roller pair and the folding-roller pair, for making the sheet form a sheet loop between the transporting-roller pair and the folding-roller pair;

a pushing member configured to push a prescribed part of the sheet loop, thereby to guide a prescribed part of the sheet to a nip part of the folding-roller pair;

a transport guide section configured to guide a prescribed part of the sheet pushed by the pushing member to the nip part of the folding-roller pair; and a restriction guide section provided in the space and configured to restrict the sheet loop, wherein the transport guide section constitutes a transporting path for transporting a sheet and comprises first and second transport guide members having horizontal surfaces parallel to each other; and the restriction guide section comprises a first restriction guide member extending in vertical direction and restricting the shape of the sheet loop, and a second restriction guide member provided between the first transport guide member and the first restriction guide members, inclining to the horizontal surface of the first transport guide member and configured to guide the sheet to a gap between the first and second transport guide members.

12. The sheet-folding apparatus according to claim 11, wherein the transporting-roller pair feeds the rear part of the sheet nipped and stopped at the folding-roller pair, thereby forming a sheet loop in the space.

13. The sheet-folding apparatus according to claim 11, wherein the transporting-roller pair feeds the front part of the sheet nipped and stopped at the transporting-roller pair, upstream in a sheet transporting direction, thereby forming a sheet loop in the space.

14. A sheet-folding apparatus for folding sheets, comprising:

a transporting-roller pair configured to transport a sheet;

a folding-roller pair configured to nip a prescribed part of the sheet and fold the sheet;

a space provided between the transporting-roller pair and the folding-roller pair, for making the sheet form a sheet loop between the transporting-roller pair and the folding-roller pair;

a pushing member configured to push a prescribed part of the sheet loop, thereby to guide a prescribed part of the sheet to a nip part of the folding-roller pair;

a transport guide section configured to guide a prescribed part of the sheet pushed by the pushing member to the nip part of the folding-roller pair; and a restriction guide section provided in the space and configured to restrict the sheet loop, wherein the space is provided below the transport guide section; and the restriction guide section has a first restriction guide member for restricting the sheet loop, in the space, at its downstream side in a sheet transporting direction and a third restriction guide member for restricting the sheet loop at its lower side, and is configured to extend the sheet loop, in the space, upstream in the sheet transporting direction.

15. The sheet-folding apparatus according to claim 14, wherein the transporting-roller pair feeds the rear part of the sheet nipped and stopped at the folding-roller pair, thereby forming a sheet loop in the space.

16. The sheet-folding apparatus according to claim 14, wherein the transporting-roller pair feeds the front part of the sheet nipped and stopped at the transporting-roller pair, upstream in a sheet transporting direction, thereby forming a sheet loop in the space.

* * * * *